US010476179B2

(12) United States Patent
Hayashi et al.

(10) Patent No.: US 10,476,179 B2
(45) Date of Patent: Nov. 12, 2019

(54) CONNECTOR AND CONNECTOR ASSEMBLY

(71) Applicant: 3M INNOVATIVE PROPERTIES COMPANY, St. Paul, MN (US)

(72) Inventors: Tatsuya Hayashi, Sagamihara (JP); Hiroyuki Matsuoka, Yokohama (JP); Toshio Ohta, Sagamihara (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/545,804

(22) PCT Filed: Jan. 27, 2016

(86) PCT No.: PCT/US2016/015052
§ 371 (c)(1),
(2) Date: Jul. 24, 2017

(87) PCT Pub. No.: WO2016/133663
PCT Pub. Date: Aug. 25, 2016

(65) Prior Publication Data

US 2018/0006384 A1 Jan. 4, 2018

(30) Foreign Application Priority Data

Feb. 17, 2015 (JP) ..... 2015-028563

(51) Int. Cl.
*H01R 4/24* (2018.01)
*H01R 4/2433* (2018.01)
(Continued)

(52) U.S. Cl.
CPC ..... *H01R 4/2433* (2013.01); *H01R 9/031* (2013.01); *H01R 12/616* (2013.01); *H01R 13/64* (2013.01)

(58) Field of Classification Search
CPC ..... H01R 4/2433; H01R 9/031; H01R 12/616
(Continued)

(56) References Cited

U.S. PATENT DOCUMENTS 4,897,041 A * 1/1990 Heiney ..... H01R 23/661 439/404
5,009,612 A * 4/1991 Rishworth ..... H01R 12/616 439/403

(Continued)

FOREIGN PATENT DOCUMENTS

EP 0 470 887 2/1992
EP 0 571 156 11/1993

(Continued)

OTHER PUBLICATIONS

PCT International Search Report from PCT/US2016/015052 dated Jul. 26, 2016, 8 pages.

*Primary Examiner* — Alexander Gilman
(74) *Attorney, Agent, or Firm* — Michael Stern

(57) ABSTRACT

A connector (100) is disclosed that includes a housing (2) having a length, a width, a first end wall (15), a second end wall (19), and a plurality of first (17) and second (18) grooves disposed on upper-portion main surface and bottom-portion main surface of a base (2). The grooves receive pluralities of first (70) and second (71) insulated conductors, respectively. A plurality of terminals (16) make contact with the first and second insulated conductors so that the first insulated conductors and the second insulated conductors are electrically connected to each other.

9 Claims, 14 Drawing Sheets

(51) Int. Cl.
*H01R 9/03* (2006.01)
*H01R 12/61* (2011.01)
*H01R 13/64* (2006.01)

(58) Field of Classification Search
USPC ..... 439/404
See application file for complete search history.

(56) References Cited

U.S. PATENT DOCUMENTS 5,199,899 A * 4/1993 Ittah ..... H01R 4/2429 439/403
5,338,220 A * 8/1994 Soes ..... H01R 4/2433 439/403
5,376,018 A * 12/1994 Davis ..... H01R 13/6593 439/405
5,498,172 A * 3/1996 Noda ..... H01R 12/616 439/404
5,964,620 A * 10/1999 Takahashi ..... H01R 9/0518 439/579
6,398,581 B1 * 6/2002 Baier ..... H01R 12/616 439/404
6,837,737 B2 * 1/2005 Baier ..... H01R 12/616 439/402
7,156,686 B1 * 1/2007 Sekela ..... H01R 12/675 439/403
7,252,534 B2 * 8/2007 Reibke ..... H01R 4/2433 439/404
7,559,789 B2 * 7/2009 Hashim ..... H01R 4/2433 439/405
8,481,868 B2 * 7/2013 Dennes ..... H01R 4/2433 174/549
9,011,174 B2 * 4/2015 Kashiyama ..... H01R 13/567 439/447

FOREIGN PATENT DOCUMENTS

| | | |
|---|---|---|
| GB | 2 034 538 | 6/1980 |
| JP | H06-089749 | 3/1994 |
| JP | H06-062468 | 9/1994 |
| JP | H07-78641 | 3/1995 |
| JP | H08-222291 | 8/1996 |
| JP | 2002-246090 | 8/2002 |
| NL | 2 007 004 | 1/2013 |

* cited by examiner

CONNECTOR AND CONNECTOR ASSEMBLY

FIELD OF THE INVENTION

One aspect of the present invention relates to a connector and a connector assembly.

BACKGROUND ART

As a connector that electrically connects a plurality of insulated conductors and another plurality of insulated conductors, various types are conventionally known. A connector according to Patent Document 1 below electrically connects a plurality of insulated conductors supported by a bottom-portion cover and a plurality of insulated conductors supported by an upper-portion cover via an electrical contact terminal. This connector engages the upper-portion cover and the bottom-portion cover with each other in a state of interposing a housing to which the electrical contact terminal is installed.

PRIOR ART DOCUMENTS

Patent Documents

Patent Document 1: Japanese Unexamined Patent Application Publication No. H08-222291

SUMMARY OF THE INVENTION

Problem to be Solved by the Invention

Here, in a situation of connecting the plurality of insulated conductors and the other plurality of insulated conductors in correspondence with each other, because the two covers, the upper-portion cover and the bottom-portion cover, come to be necessary, there is a need to work so incorrect assembly does not occur. Therefore, it is sought of a worker to work with care. Moreover, upon arranging the correspondence relationship between the plurality of insulated conductors and the other plurality of insulated conductors, they need to be electrically connected to each other. Therefore, it is sought of the worker to work with care with regard to orientations of the insulated conductors. From the above, in order to reduce a workload of the worker, a connector is in demand where assembly work can be easily performed.

Means for Solving the Problem

A connector according to one aspect of the present invention is a connector that electrically connects a plurality of first insulated conductors and a plurality of second insulated conductors that correspond, wherein the connector is provided with a housing; the housing is provided with a base that has a length along a first direction between a first edge portion and a second edge portion that oppose each other and a width along a second direction orthogonal to the first direction, a first end wall and a second end wall that extend in an up-and-down direction respectively from the first edge portion and the second edge portion, a plurality of first grooves and a plurality of second grooves that are provided in an upper-portion main surface and a bottom-portion main surface of the base that oppose each other and respectively receive the plurality of first insulated conductors and the plurality of second insulated conductors, and a plurality of electrical contact terminals that is provided in correspondence with the first grooves and the second grooves and contacts the first insulated conductors received in the first grooves and the second insulated conductors received in the second grooves so the first insulated conductors and the second insulated conductors are electrically connected to each other; and the housing is set with a symmetry axis that is orthogonal to the first direction and the second direction.

In such an aspect, the housing has the first end wall and the second end wall that extend in the up-and-down direction, the plurality of first grooves and the plurality of second grooves that respectively receive the plurality of first insulated conductors and the plurality of second insulated conductors, and the plurality of electrical contact terminals. Therefore, the upper-portion cover can be assembled to the housing together with the plurality of first insulated conductors, and the bottom-portion cover can be assembled to the housing together with the plurality of second insulated conductors. Moreover, the plurality of first insulated conductors and the plurality of second insulated conductors received by the plurality of first grooves and the plurality of second grooves can be electrically connected to each other by the electrical contact terminals. Here, the housing is set with the symmetry axis that is orthogonal to the first direction and the second direction. Therefore, the upper-portion cover can be assembled to an upper portion of the housing regardless of orientation, and the bottom-portion cover can be assembled to a bottom portion of the housing regardless of orientation. By the above, ease of assembly work for a connector assembly can be improved.

Effect of the Invention

According to one aspect of the present invention, the ease of the assembly work for the connector assembly can be improved.

DESCRIPTION OF EMBODIMENTS

An embodiment of the present invention is described in detail below with reference to the attached drawings. Note that in the description below, identical or corresponding elements are labeled with the same reference signs, and redundant description is omitted. Moreover, the terms, "X-axis direction," "Y-axis direction," and "Z-axis direction" are based on the illustrated directions and are for convenience.

Figure 1:
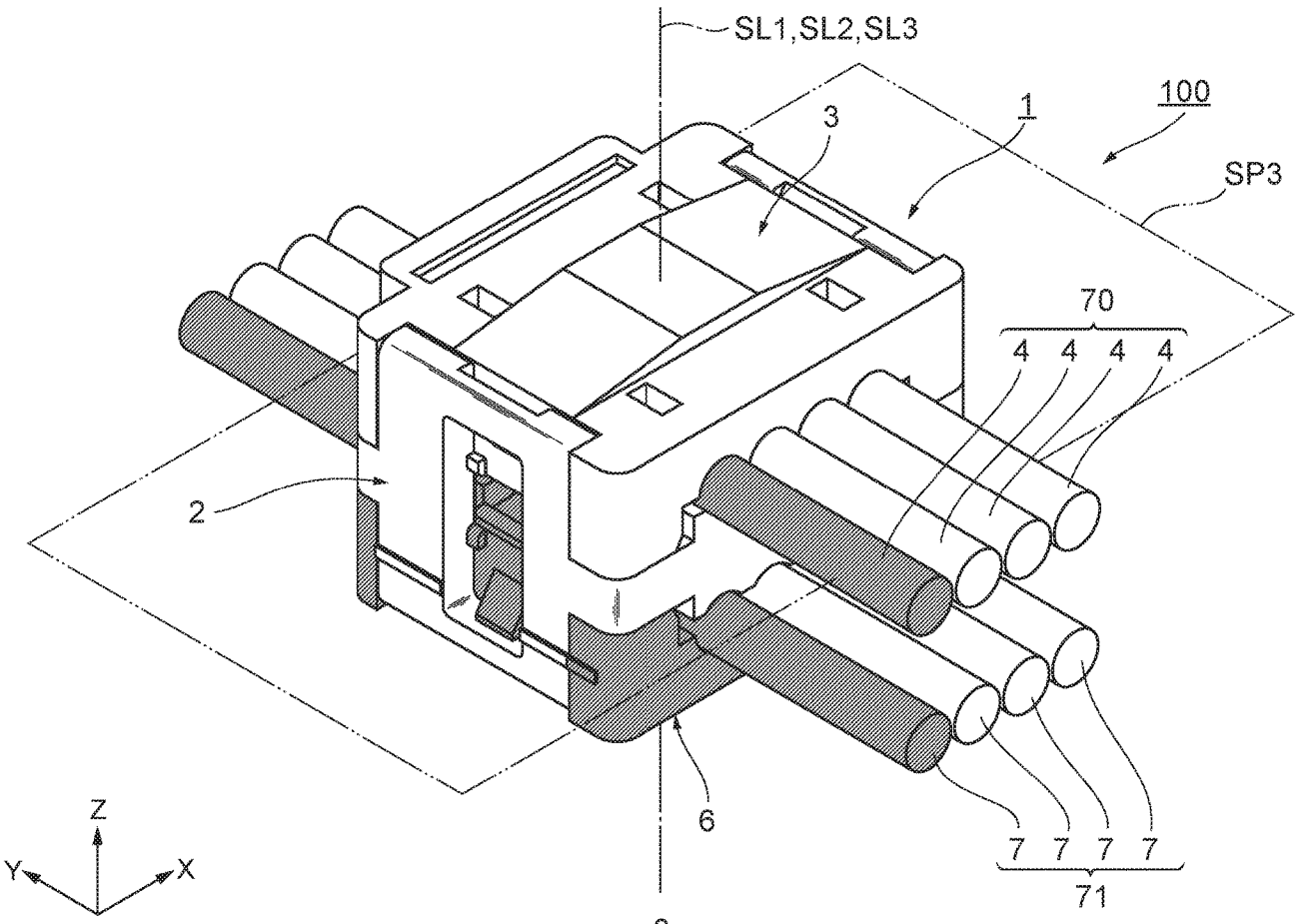
FIG. 1 is a perspective view of a connector assembly using a connector according to an embodiment.
Figure 2:
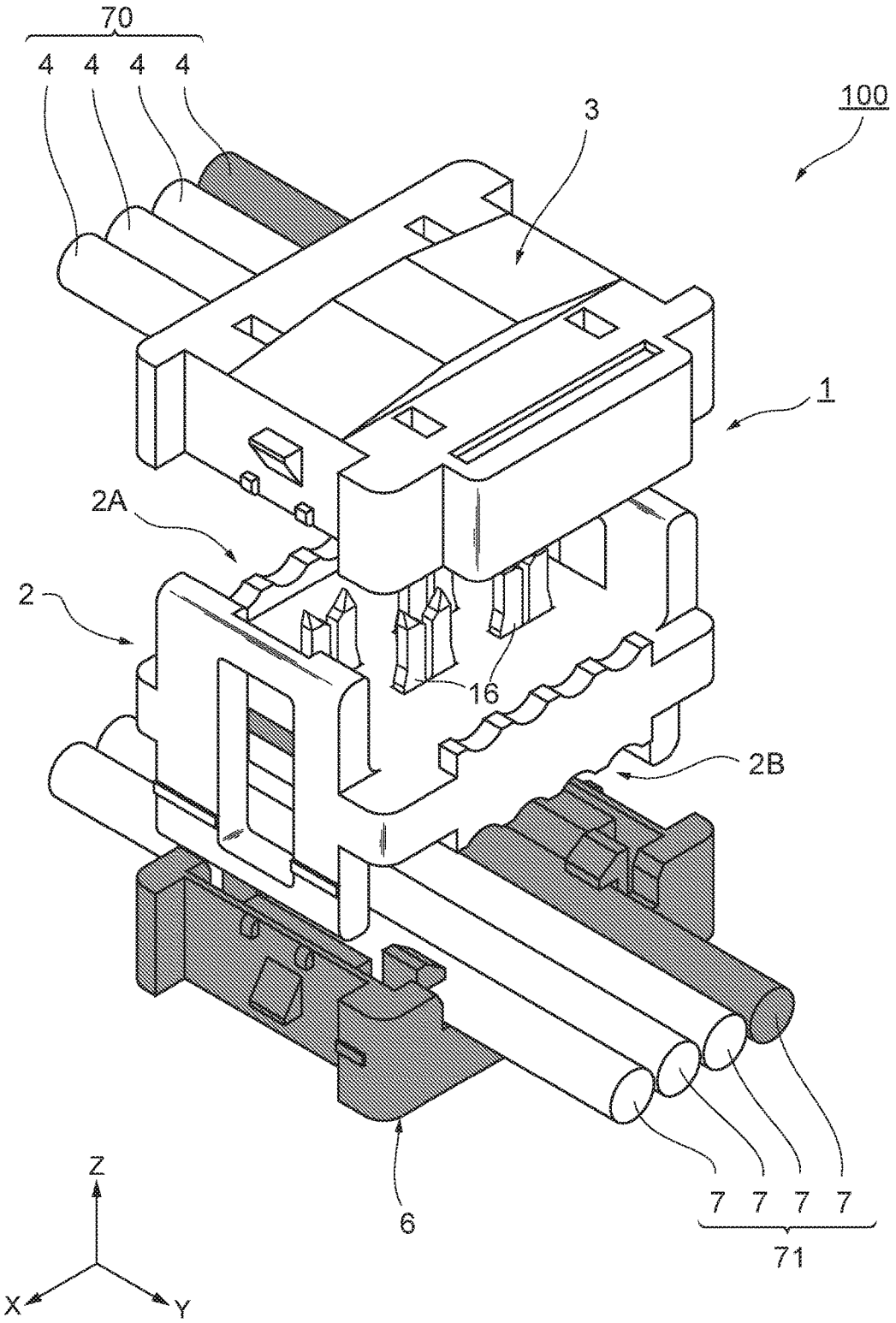
FIG. 2 is an exploded perspective view of the connector assembly according to the embodiment.

As illustrated in FIGS. 1 and 2, a connector assembly 100 is provided with a housing 2, an upper-portion cover 3 detachably assembled to an upper portion 2A of the housing 2, a plurality of first insulated conductors 4 disposed between the housing 2 and the upper-portion cover 3, a bottom-portion cover 6 detachably assembled to a bottom portion 2B of the housing 2, a plurality of second insulated conductors 7 disposed between the housing 2 and the bottom-portion cover 6, and a plurality of electrical connection terminals 16 contacting the first insulated conductors 4 and the second insulated conductors 7 to electrically connect the first insulated conductors 4 and the second insulated conductors 7 to each other. Among these, a connector 1 is configured as a component provided with the housing 2, the upper-portion cover 3, the bottom-portion cover 6, and the electrical connection terminals 16. The connector 1 according to the present embodiment electrically connects the plurality of first insulated conductors 4 and the plurality of second insulated conductors 7, which correspond. A bundle of the plurality of first insulated conductors 4 is referred to as "branch line 70," and a bundle of the plurality of second insulated conductors 7 is referred to as "trunk line 71." The connector 1 can cause branching from the trunk line 71 disposed in the bottom portion 2B of the housing 2 to the branch line 70 disposed in the upper portion 2A of the housing 2. Note that in the present embodiment, the branch line 70 and the trunk line 71 are configured by four insulated conductors 4, 7. However, the number of insulated conductors 4, 7 is not limited in particular if this number is plural.

Note that in the present specification, the terms "upper" and "lower (bottom)" are used with a state as reference where the branch line 70 and the trunk line 71 extend in a horizontal direction, the trunk line 71 is disposed on a lower side, and the branch line 70 is disposed on an upper side (the state illustrated in FIG. 1). However, in a usage time of the connector 1, an orientation is not limited. Moreover, for the sake of description, an XYZ coordinate system is set relative to the housing 2 of the connector 1. This defines "X-axis direction" and "Y-axis direction," which are orthogonal to each other in a horizontal plane, and defines "Z-axis direction," which is orthogonal to the X-axis direction and the Y-axis direction. "First direction" in the claims corresponds to the X-axis direction, "second direction" corresponds to the Y-axis direction, and "up-and-down direction" corresponds to the Z-axis direction. The upper side is a Z-axis-direction positive side, and the lower side is a Z-axis-direction negative side. That is, "upward" corresponds to a Z-axis positive direction, and "downward" corresponds to a Z-axis negative direction.

Housing

A configuration of the housing 2 is described with reference to FIGS. 3 and 4. The housing 2 is provided with a base 10, a first upper-portion end wall 11 and a second upper-portion end wall 12, a first bottom-portion end wall 13 and a second bottom-portion end wall 14, the plurality of electrical contact terminals 16, and a plurality of first grooves 17 and a plurality of second grooves 18.

The base 10 is a member of a rectangular plate shape that functions as a substrate of the housing 2. The base 10 has a first edge portion 10*a* and a second edge portion 10*b* that oppose each other in the X-axis direction, a third edge portion 10*c* and a fourth edge portion 10*d* that oppose each other in the Y-axis direction, and an upper-portion main surface 10*e* and a bottom-portion main surface 10*f* that oppose each other in the Z-axis direction. The first edge portion 10*a* is an edge portion on an X-axis positive side, and the second edge portion 10*b* is an edge portion on an X-axis negative side. The third edge portion 10*c* is an edge portion on a Y-axis positive side, and the fourth edge portion 10*d* is an edge portion on a Y-axis negative side. The third edge portion 10*c* and the fourth edge portion 10*d* extend along the X-axis direction between the first edge portion 10*a* and the second edge portion 10*b*. The base 10 has a length along the X-axis direction and a width along the Y-axis direction.

The first upper-portion end wall 11 and the second upper-portion end wall 12 extend upward from the upper-portion main surface 10*e* of the base 10, interpose the upper-portion main surface 10*e*, and oppose each other in a first opposing direction. The first bottom-portion end wall 13 and the second bottom-portion end wall 14 extend downward from the bottom-portion main surface 10*f* of the base 10, interpose the bottom-portion main surface 10*f*, and oppose each other in a second opposing direction. Each end wall 11, 12, 13, 14 forms a rectangular plate shape. In the present embodiment, the first opposing direction and the second opposing direction match, and both are the X-axis direction. Therefore, the first upper-portion end wall 11 and the first bottom-portion end wall 13 are configured as a first end wall 15 that is continuous in the up-and-down direction. The second upper-portion end wall 12 and the second bottom-portion end wall 14 are configured as a second end wall 19 that is continuous in the up-and-down direction. Positional relationships between the end walls 11, 12, 13, 14 are described below.

A first upper-portion opening portion 21 and a second upper-portion opening portion 22 are formed in the first upper-portion end wall 11 and the second upper-portion end wall 12. A first bottom-portion opening portion 23 and a second bottom-portion opening portion 24 are formed in the first bottom-portion end wall 13 and the second bottom-portion end wall 14. The opening portions 21, 22, 23, 24 are configured by a rectangular through hole (penetrating in the X-axis direction) formed in a central position in the Y-axis direction of the base 10. However, the opening portions 21, 22, 23, 24 do not have to be formed in the central position in the Y-axis direction and may be formed in a position shifted from this central position. Moreover, the opening portions 21, 22, 23, 24 do not have to be rectangular, and a shape thereof is not limited in particular. In the present embodiment, the first upper-portion opening portion 21 and the first bottom-portion opening portion 23 are continuous due to the first edge portion 10*a* of the base 10 being notched. That is, a rectangular first opening portion 26 is formed in the first end wall 15. However, the opening portions 21, 23 do not need to be continuous. The second upper-portion opening portion 22 and the second bottom-portion opening portion 24 are continuous due to the second edge portion 10*b* of the base 10 being notched. That is, a rectangular second opening portion 27 is formed in the second end wall 19. However, the opening portions 22, 24 do not need to be continuous. Note that the opening portions 21, 22, 23, 24 do not need to be configured by a through hole that completely penetrates each end wall and may be configured by, for example, a bottomed groove portion that does not penetrate to a surface on an outer side of the end wall.

Upper edges of the first upper-portion opening portion 21 and the second upper-portion opening portion 22 are configured as engaged portions 21*a*, 22*a* for being locked to an engaging portion of the upper cover 3. Inclined surfaces 11*a*, 12*a* that incline downward toward an X-axis-direction inner side by notching an upper end portion of the upper-portion end walls 11, 12 are formed above the engaged portions 21*a*, 22*a*. Upper edges of the first bottom-portion opening portion 23 and the second bottom-portion opening portion 24 are configured as engaged portions 23*a*, 24*a* for being locked to an engaging portion of the bottom cover 6. Inclined surfaces 13*a*, 14*a* that incline upward toward the X-axis-direction inner side by notching a lower end portion of the bottom-portion end walls 13, 14 are formed below the engaged portions 23*a*, 24*a*. A marker 28 configured by a protruding portion extending in the Y-axis direction is formed on an outer surface of the bottom-portion end walls 13, 14.

The plurality of first grooves 17 is provided on the upper-portion main surface 10*e* and respectively receives the plurality of first insulated conductors 4. The plurality of first grooves 17 is provided on the third edge portion 10*c* and the fourth edge portion 10*d* in the upper-portion main surface 10*e*. Specifically, upper-side step portions 31, 32 extending upward are formed on the third edge portion 10*c* and the fourth edge portion 10*d* of the base 10. The upper-side step portions 31, 32 have both end portions in the X-axis direction disposed in positions separated to the X-axis-direction inner side from the first edge portion 10*a* and the second edge portion 10*b*. The plurality of first grooves 17 is formed by notching arcs in an upper surface of the upper-side step portions 31, 32. The plurality of first grooves 17 extends along the Y-axis direction and is arranged at equal intervals in the X-axis direction. The first grooves 17 are only formed in the upper-side step portions 31, 32. That is, in the upper-portion main surface 10*e*, the first grooves 17 are not formed in a region between the upper-side step portions 31, 32. By this, the first grooves 17 become discontinuous along a groove-length direction (Y-axis direction). The plurality of first grooves 17 of the upper-side step portion 31 and the plurality of first grooves 17 of the upper-side step portion 32 are disposed in positions corresponding to each other in the X-axis direction. Therefore, when viewed from the Y-axis direction, the plurality of first grooves 17 of the upper-side step portion 31 is disposed so as to overlap the plurality of first grooves 17 of the upper-side step portion 32. However, the first grooves 17 may be continuous along the groove-length direction (Y-axis direction).

The plurality of second grooves 18 is provided on the bottom-portion main surface 10*f* and respectively receives the plurality of second insulated conductors 7. The plurality of second grooves 18 is provided on the third edge portion 10*c* and the fourth edge portion 10*d* in the bottom-portion main surface 10*f*. Specifically, lower-side step portions 33, 34 extending downward are formed on the third edge portion 10*c* and the fourth edge portion 10*d* of the base 10. The lower-side step portions 33, 34 have both end portions in the X-axis direction disposed in positions separated to the X-axis-direction inner side from the first edge portion 10*a* and the second edge portion 10*b*. The plurality of second grooves 18 is formed by notching arcs in an upper surface of the lower-side step portions 33, 34. The plurality of second grooves 18 extends along the Y-axis direction and is arranged at equal intervals in the X-axis direction.

The second grooves 18 are only formed in the lower-side step portions 33, 34. That is, in the bottom-portion main surface 10*f*, the second grooves 18 are not formed in a region between the lower-side step portions 33, 34. By this, the second grooves 18 become discontinuous along a groove-length direction (Y-axis direction). The plurality of second grooves 18 of the lower-side step portion 33 and the plurality of second grooves 18 of the lower-side step portion 34 are disposed in positions corresponding to each other in the X-axis direction. Therefore, when viewed from the Y-axis direction, the plurality of second grooves 18 of the lower-side step portion 33 is disposed so as to overlap the plurality of second grooves 18 of the lower-side step portion 34. However, the second grooves 18 may be continuous along the groove-length direction (Y-axis direction).

The plurality of first grooves 17 and the plurality of second grooves 18 are formed in positions corresponding to each other. Specifically, the plurality of first grooves 17 and second grooves 18 is in a positional relationship of planar symmetry interposing the base 10. When viewed from the Z-axis direction, the plurality of first grooves 17 formed in the upper-side step portions 31, 32 is disposed so as to overlap the plurality of second grooves 18 formed in the lower-side step portions 33, 34.

Figure 8:
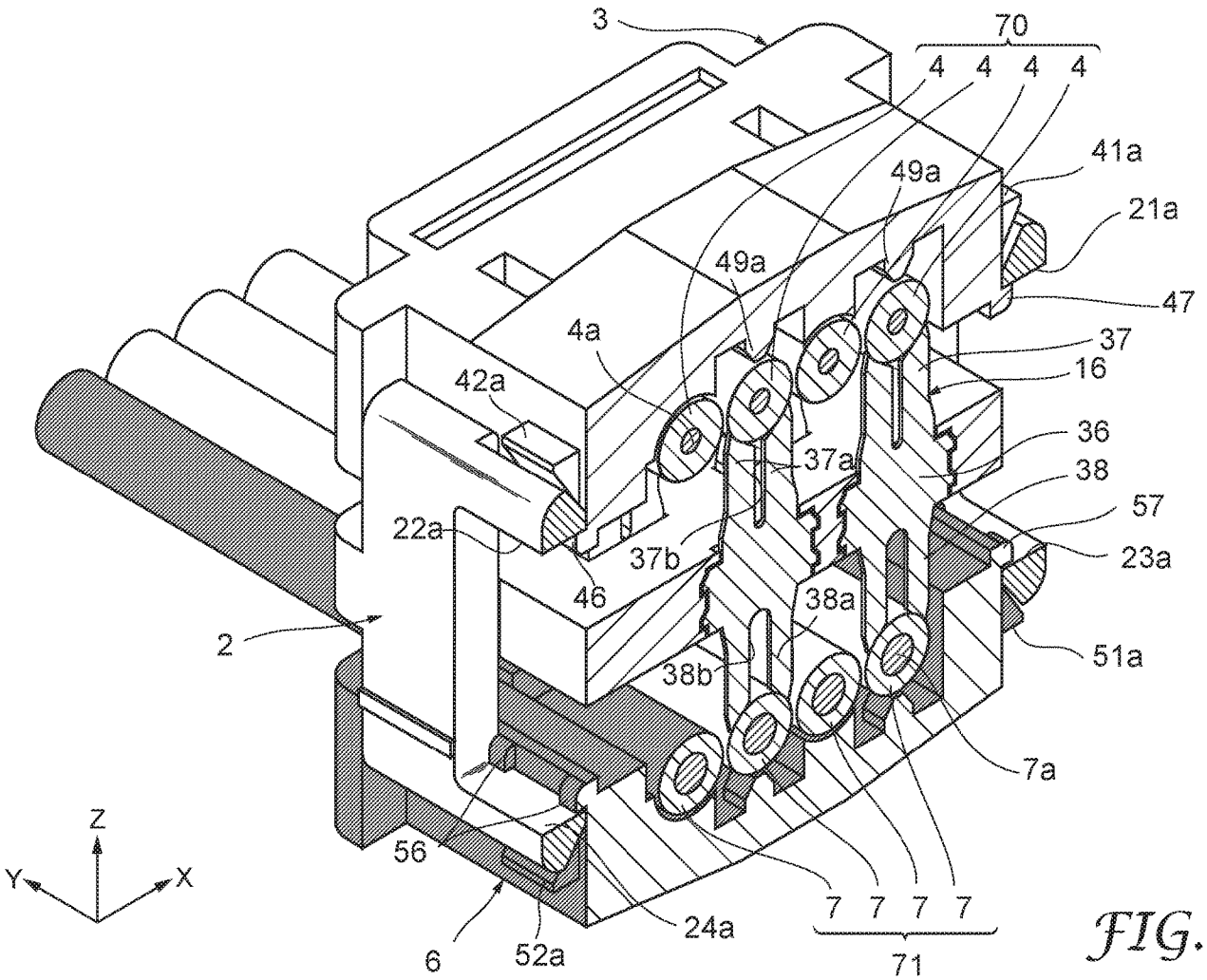
FIG. 8 is a partial cross-sectional perspective view of the connector assembly according to the embodiment.

The plurality of electrical contact terminals 16 is conductive members that are provided in correspondence with the first grooves 17 and the second grooves 18 and contact the first insulated conductors 4 received in the first grooves 17 and the second insulated conductors 7 received in the second grooves 18 so the first insulated conductors 4 and the second insulated conductors 7 are electrically connected to each other. As illustrated in FIG. 8, the electrical contact terminal 16 is provided with a central portion 36 that is embedded in the base 10 in a position corresponding to the first groove 17 and the second groove 18, a first connection portion 37 that extends upward from an upper end of the central portion 36, and a second connection portion 38 that extends downward from a lower end of the central portion 36. The first connection portion 37 can be electrically connected to the first insulated conductor 4 received in the first groove 17. The second connection portion 38 can be electrically connected to the second insulated conductor 7 received in the second groove 18. The plurality of electrical contact terminals 16 is arranged in the X-axis direction so as to correspond to each groove 17, 18 in a central region in the Y-axis direction of the base 10. The plurality of electrical contact terminals 16 is disposed in a zigzag pattern. That is, in a situation where one electrical contact terminal 16 from among the plurality of electrical contact terminals 16 is disposed more on the Y-axis negative side than the central position in the Y-axis direction of the base 10, an electrical contact terminal 16 adjacent thereto in the X-axis direction is disposed more on the Y-axis positive side than the central position in the Y-axis direction. Note that the plurality of electrical contact terminals 16 does not have to be disposed in the zigzag pattern; they may be disposed so as to line up in a straight line along the X-axis direction or may be disposed so as to line up in a diagonal straight line in a direction inclined relative to the X-axis direction.

The electrical contact terminal 16 is configured by processing a metal plate into a predetermined shape and is configured to be substantially planar. The first connection portion 37 is configured by a pair of blade portions 37*a*, 37*a* extending upward from the central portion 36. A gap 37*b* extending upward is formed between the blade portions 37*a*, 37*a*. The blade portions 37*a*, 37*a* have a function of removing a covering of the first insulated conductor 4 at a portion of the gap 37*b*. That is, the first insulated conductor 4 pressed from above by the upper-portion cover 3 enters the gap 37*b* and has the covering thereof partially cut by the blade portions 37*a*, 37*a*. By this, the blade portions 37*a*, 37*a* and a conductor 4*a* of the first insulated conductor 4 make contact. The second connection portion 38 is configured by a pair of blade portions 38*a*, 38*a* extending downward from the central portion 36. A gap 38*b* extending downward is formed between the blade portions 38*a*, 38*a*. The blade portions 38*a*, 38*a* have a function of removing a covering of the second insulated conductor 7 at a portion of the gap 38*b*. That is, the second insulated conductor 7 pressed from below by the bottom-portion cover 6 enters the gap 38*b* and has the covering thereof partially cut by the blade portions 38*a*, 38*a*. By this, the blade portions 38*a*, 38*a* and a conductor 7*a* of the second insulated conductor 7 make contact. By this, the conductor 4*a* of the first insulated conductor 4 and the conductor 7*a* of the second insulated conductor 7 are electrically connected via the electrical contact terminal 16. Note that in a situation where a diameter of the conductor 7*a* of the second insulated conductor 7 is thicker than that of the conductor 4*a* of the first insulated conductor 4, a size of the gap 38*b* of the second connection portion 38 becomes greater than a size of the gap 37*b* of the first connection portion 37. However, the size of the gap 38*b* of the second connection portion 38 may be smaller than or the same as the size of the gap 37*b* of the first connection portion 37.

Figure 3:
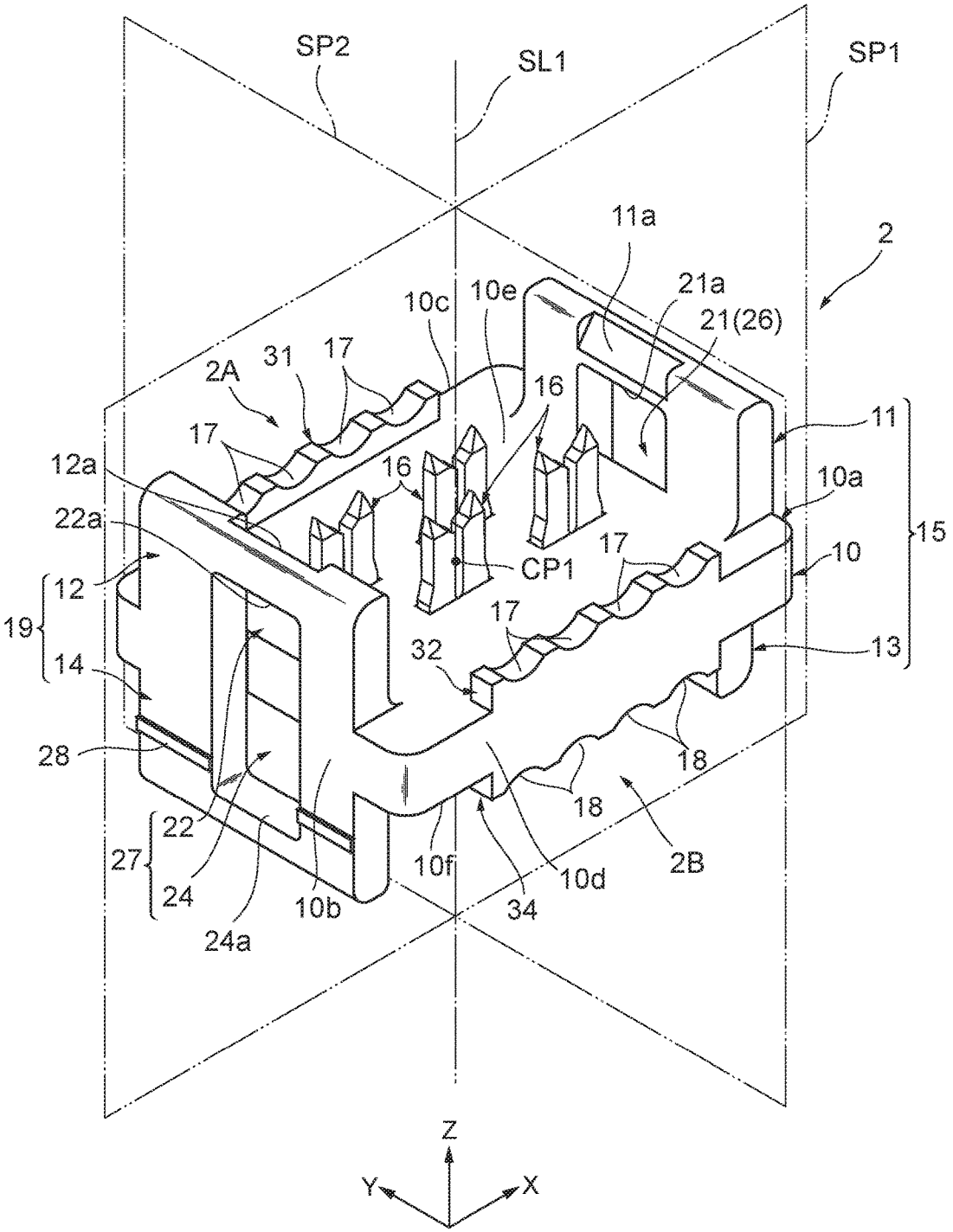
FIG. 3 is a perspective view of a housing of the connector according to the embodiment.

As illustrated in FIG. 3, in a situation where the upper-portion main surface 10*e* is viewed downward from above (that is, toward the Z-axis negative direction), at least the first upper-portion end wall 11 and the second upper-portion end wall 12 are in point symmetry with an upper-portion symmetry point CP1 set on the upper-portion main surface 10*e* as reference. In the present embodiment, the upper-portion symmetry point CP1 is set in a central position (point where a centerline in the X-axis direction and a centerline in the Y-axis direction intersect) of the upper-portion main surface 10*e* of the base 10. Therefore, an entirety of the upper portion 2A of the housing 2 is in point symmetry with the upper-portion symmetry point CP1 as reference. That is, a shape of the base 10 and shapes and dispositions of the plurality of first grooves 17 and the plurality of electrical contact terminals 16 are in point symmetry with the upper-portion symmetry point CP1 as reference. Note that here, "point symmetry" does not require all shapes to be completely in point symmetry; for example, in a situation where the base 10 or the upper-portion end walls 11, 12 are formed with a rib, a hole, or the like (that does not affect functionality as a connector), these structures may be ignored. Note that in the description hereinbelow, similarly, in a situation where the term "point symmetry" is used, a structure such as a rib or a hole that does not affect performance as a connector may be ignored. Note that it is sufficient for at least the upper-portion end walls 11, 12 to be in point symmetry; for example, depending on the shape of the base 10 and the disposition of the electrical contact terminals 16, these do not have to be in point symmetry. Such is also the case for the following components.

Figure 4:
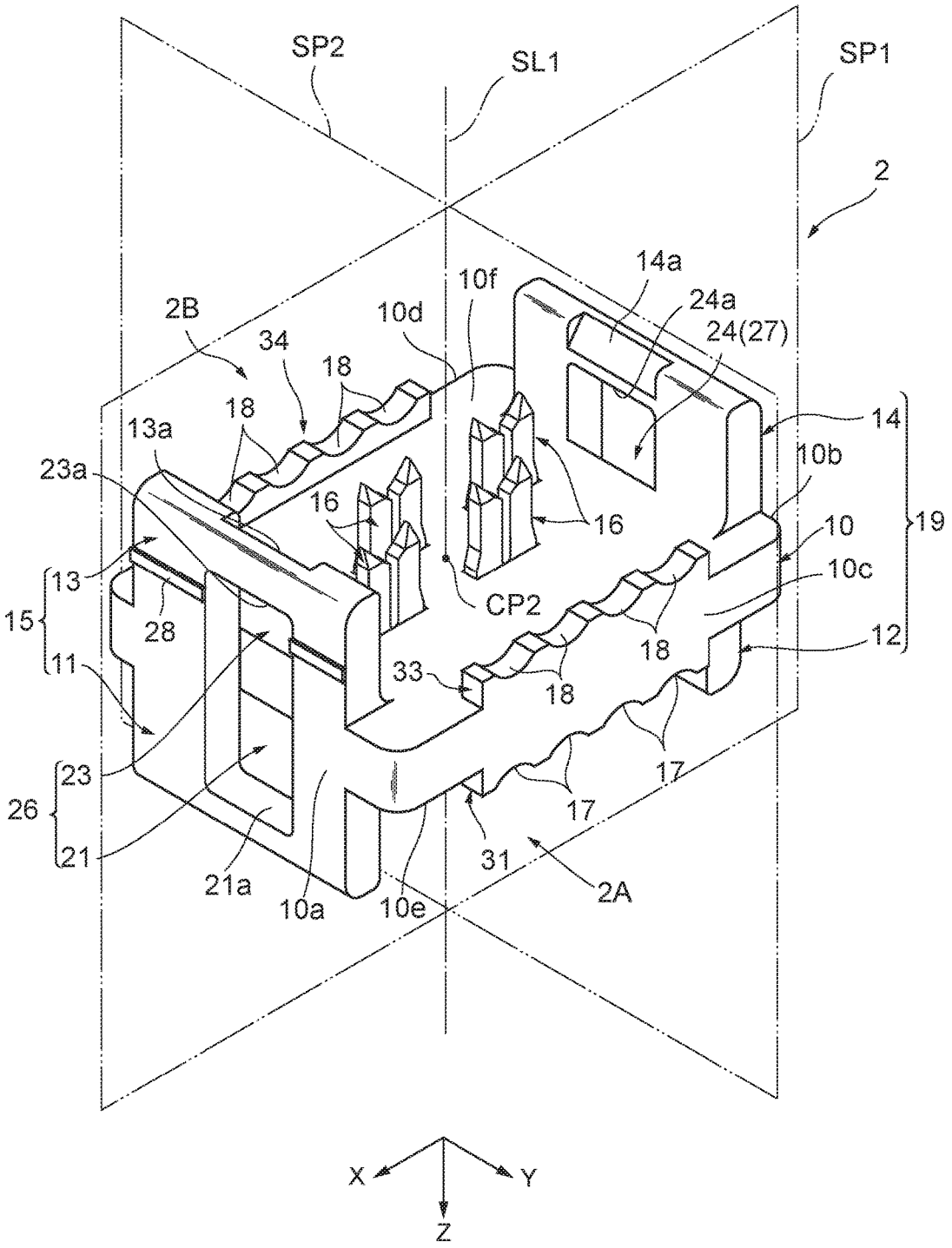
FIG. 4 is a perspective view of the housing of the connector according to the embodiment.

As illustrated in FIG. 4, in a situation where the bottom-portion main surface 10*f* is viewed upward from below (that is, toward the Z-axis positive direction), at least the first bottom-portion end wall 13 and the second bottom-portion end wall 14 are in point symmetry with a bottom-portion symmetry point CP2 set on the bottom-portion main surface 10*f* as reference. In the present embodiment, the bottom-portion symmetry point CP2 is set in a central position (point where a centerline in the X-axis direction and a centerline in the Y-axis direction intersect) of the bottom-portion main surface 10*f* of the base 10. Therefore, an entirety of the bottom portion 2B of the housing 2 is in point symmetry with the bottom-portion symmetry point CP2 as reference. That is, the shape of the base 10 and shapes and dispositions of the plurality of second grooves 18 and the plurality of electrical contact terminals 16 are in point symmetry with the bottom-portion symmetry point CP2 as reference.

In the present embodiment, both the upper-portion symmetry point CP1 and the bottom-portion symmetry point CP2 are set in a central position of the base 10, and viewed from the up-and-down direction, the symmetry points CP1, CP2 are set in positions overlapping each other. Therefore, the housing 2 can be set with one symmetry axis SL1 that is orthogonal to the X-axis direction and the Y-axis direction. The symmetry axis SL1 passes through the upper-portion symmetry point CP1 and the bottom-portion symmetry point CP2. Here, "symmetry axis" refers to an axis where when the housing 2 is rotated 180° around this symmetry axis a relationship is established of overlapping a shape before rotation. The symmetry axis SL1 is a virtual line formed in a portion where a virtual plane SP1 and a virtual plane SP2 set relative to the housing 2 intersect. The virtual plane SP1 is a plane that divides the housing 2 at a central position in the Y-axis direction and spreads orthogonally to the Y axis. The virtual plane SP2 is a plane that divides the housing 2 at a central position in the X-axis direction and spreads orthogonally to the X axis.

Figure 9B:
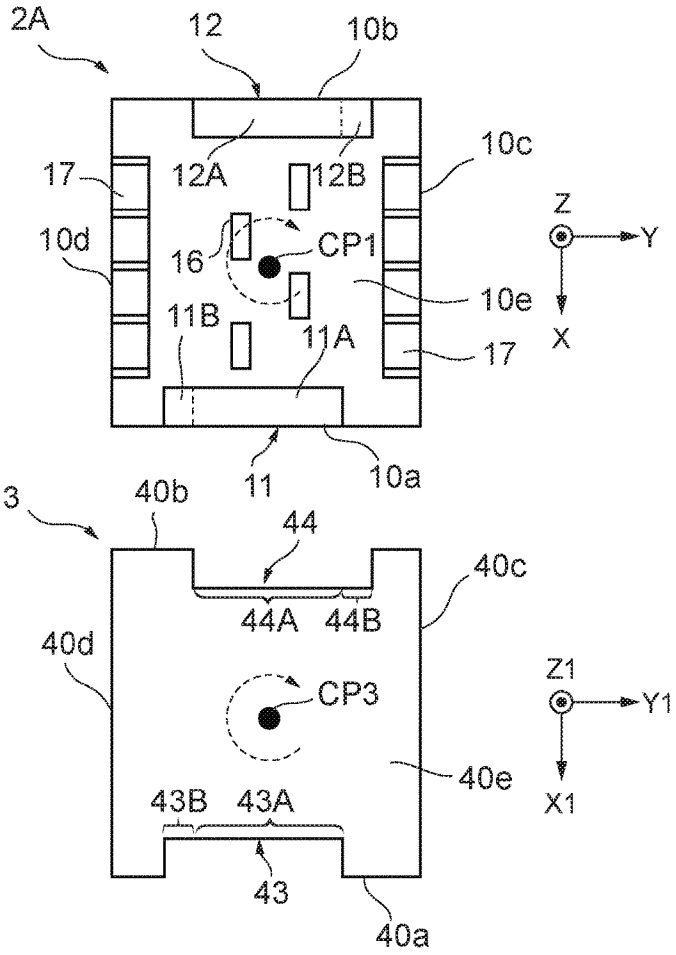
FIG. 9 is a schematic view of the housing and the upper-portion cover.
Figure 9A:
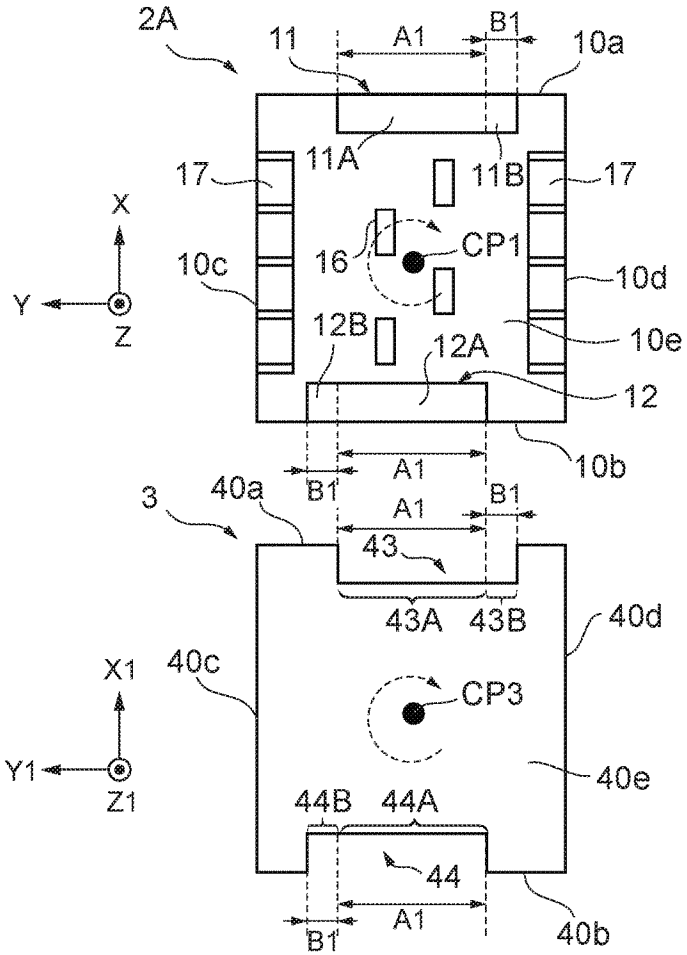

Next, a point-symmetry structure of the upper portion 2A of the housing 2 is described in more detail with reference to FIG. 9. FIG. 9 is a schematic view illustrating the upper portion 2A viewing the upper-portion main surface 10*e* downward from above (that is, toward the Z-axis negative direction). As illustrated in FIG. 9, a length along the Y-axis direction of the first upper-portion end wall 11 is shorter than a length of the first edge portion 10*a* of the base 10. A length along the Y-axis direction of the second upper-portion end wall 12 is shorter than a length of the second edge portion 10*b* of the base 10. Neither the first upper-portion end wall 11 nor the second upper-portion end wall 12 reaches the third edge portion 10*c* and the fourth edge portion 10*d*. That is, both end portions in the Y-axis direction of the upper-portion end walls 11, 12 are respectively separated from the edge portions 10*c*, 10*d*.

The first upper-portion end wall 11 and the second upper-portion end wall 12 have common portions 11A, 12A that are portions overlapping each other in the X-axis direction. A dimension of the common portions 11A, 12A is dimension A1. The first upper-portion end wall 11 and the second upper-portion end wall 12 respectively have a first upper-portion offset portion 11B and a second upper-portion offset portion 12B by being offset from each other along the Y-axis direction. An offset amount of the first upper-portion offset portion 11B and an offset amount of the second upper-portion offset portion 12B are the same, both being dimension B1. The first upper-portion offset portion 11B and the second upper-portion offset portion 12B are offset with a clockwise direction relative to the upper-portion symmetry point CP1 as reference. Note that "offset amount" is a dimension along the Y-axis direction of a portion (that is, an offset portion) protruding in either direction in the Y-axis direction more than the common portions 11A, 12A from among the first upper-portion end wall 11 and the second upper-portion end wall 12. Subsequent "offset amounts" of the bottom-portion end walls 13, 14 and groove portions 43, 44, 53, 54 are in the same spirit.

In a situation where the clockwise direction is set relative to the upper-portion symmetry point CP1, in a region more on the X-axis positive side than the upper-portion symmetry point CP1 (region on a first-edge-portion 10*a* side), a directional component in the Y-axis negative direction (direction heading from the third edge portion 10*c* toward the fourth edge portion 10*d*) arises. Therefore, the first upper-portion end wall 11 that is disposed in this region is offset in the Y-axis negative direction. The first upper-portion offset portion 11B protrudes by a dimension B1 in the Y-axis negative direction from the common portion 11A. Therefore, the first upper-portion end wall 11 is disposed in a position near the fourth edge portion 10*d* compared to the third edge portion 10*c*. Meanwhile, in the situation where the clockwise direction is set relative to the upper-portion symmetry point CP1, in a region more on the X-axis negative side than the upper-portion symmetry point CP1 (region on a second-edge-portion 10*b* side), a directional component in the Y-axis positive direction (direction heading from the fourth edge portion 10*d* toward the third edge portion 10*c*) arises. Therefore, the second upper-portion end wall 12 that is disposed in this region is offset in the Y-axis positive direction. The second upper-portion offset portion 12B protrudes by the dimension B1 in the Y-axis positive direction from the common portion 12A. Therefore, the second upper-portion end wall 12 is disposed in a position near the third edge portion 10*c* compared to the fourth edge portion 10*d*.

By a configuration such as that described above, as evident in comparing FIGS. 9(*a*) and 9(*b*), an appearance of the upper portion 2A is identical to that of a situation where the housing 2 is rotated 180° around the upper-portion symmetry point CP1.

Figure 10B:
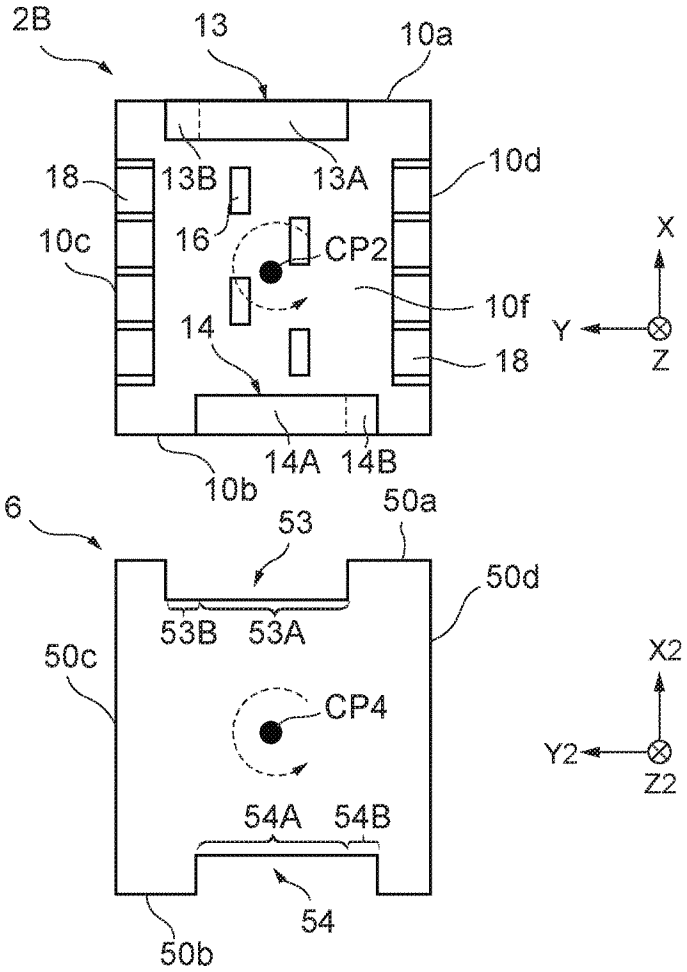
FIG. 10 is a schematic view of the housing and the bottom-portion cover.
Figure 10A:
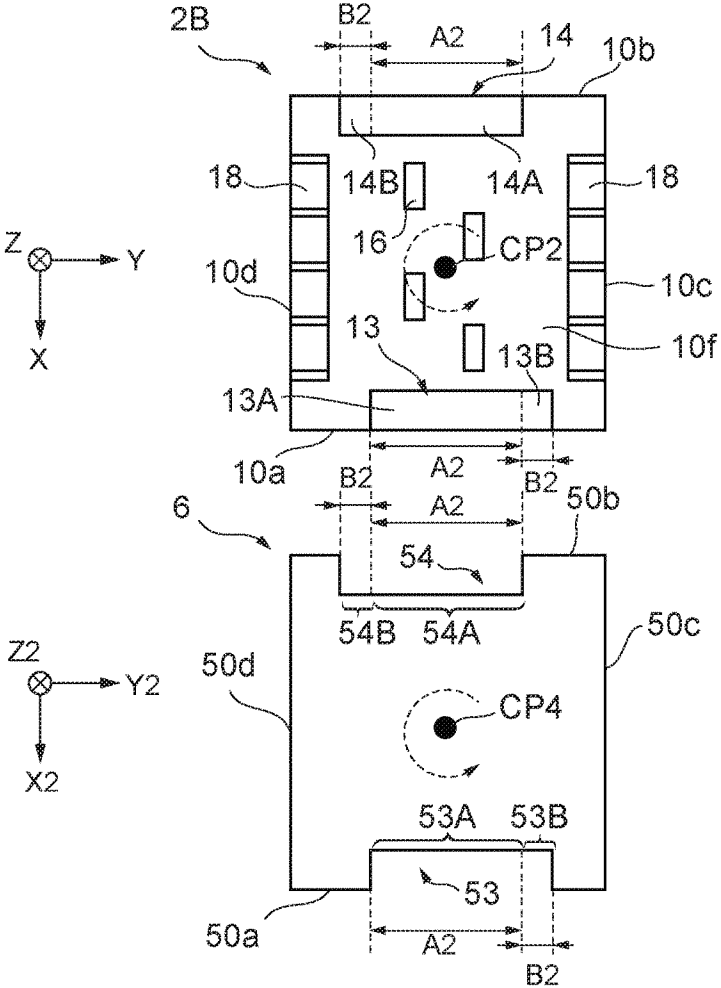

Next, a point-symmetry structure of the bottom portion 2B of the housing 2 is described in more detail with reference to FIG. 10. FIG. 10 is a schematic view illustrating the bottom portion 2B viewing the bottom-portion main surface 10*f* upward from below (that is, toward the Z-axis positive direction). As illustrated in FIG. 10, a length along the Y-axis direction of the first bottom-portion end wall 14 is shorter than the length of the first edge portion 10*a* of the base 10. A length along the Y-axis direction of the second bottom-portion end wall 14 is shorter than the length of the second edge portion 10*b* of the base 10. Neither the first bottom-portion end wall 13 nor the second bottom-portion end wall 14 reaches the third edge portion 10*c* and the fourth edge portion 10*d*. That is, both end portions in the Y-axis direction of the bottom-portion end walls 13, 14 are respectively separated from the edge portions 10*c*, 10*d*.

The first bottom-portion end wall 13 and the second bottom-portion end wall 14 have common portions 13A, 14B that are portions overlapping each other in the X-axis direction. A dimension of the common portions 13A, 14B is dimension A2. The first bottom-portion end wall 13 and the second bottom-portion end wall 14 respectively have a first bottom-portion offset portion 13B and a second bottom-portion offset portion 14B by being offset from each other along the Y-axis direction. An offset amount of the first bottom-portion offset portion 13B and an offset amount of the second bottom-portion offset portion 14B are the same, both being dimension B2. The first bottom-portion offset portion 13B and the second bottom-portion offset portion 14B are offset with a counterclockwise direction relative to the bottom-portion symmetry point CP2 as reference. Note that in the present embodiment, the dimension B2 that is the offset amount is identical to the dimension B1 that is the offset amount on an upper-portion 2A side. Moreover, the dimension A2 of the common portions 13A, 14B is also identical to the dimension A1 of the common portions 11A, 12A on the upper-portion 2A side. However, the dimension B2 may be different from the dimension B1, and the dimension A2 may also be different from the dimension A1.

In a situation where the counterclockwise direction is set relative to the bottom-portion symmetry point CP2, in a region more on the X-axis positive side than the bottom-portion symmetry point CP2 (region on the first-edge-portion 10*a* side), a directional component in the Y-axis positive direction (direction heading from the fourth edge portion 10*d* toward the third edge portion 10*c*) arises. Therefore, the first bottom-portion end wall 13 that is disposed in this region is offset in the Y-axis positive direction. The first bottom-portion offset portion 13B protrudes by the dimension B2 in the Y-axis positive direction from the common portion 13A. Therefore, the first bottom-portion end wall 13 is disposed in a position near the third edge portion 10*c* compared to the fourth edge portion 10*d*. Meanwhile, in the situation where the counterclockwise direction is set relative to the bottom-portion symmetry point CP2, in a region more on the X-axis negative side than the bottom-portion symmetry point CP2 (region on the second-edge-portion 10*b* side), a directional component in the Y-axis negative direction (direction heading from the third edge portion 10*c* toward the fourth edge portion 10*d*) arises. Therefore, the second bottom-portion end wall 14 that is disposed in this region is offset in the Y-axis negative direction. The second bottom-portion offset portion 14B protrudes by the dimension B2 in the Y-axis negative direction from the common portion 14A. Therefore, the second bottom-portion end wall 14 is disposed in a position near the fourth edge portion 10*d* compared to the third edge portion 10*c*.

By a configuration such as that described above, as evident in comparing FIGS. 10(*a*) and 9(*b*), an appearance of the bottom portion 2B is identical to that of a situation where the housing 2 is rotated 180° around the bottom-portion symmetry point CP2.

Upper-Portion Cover

Figure 5:
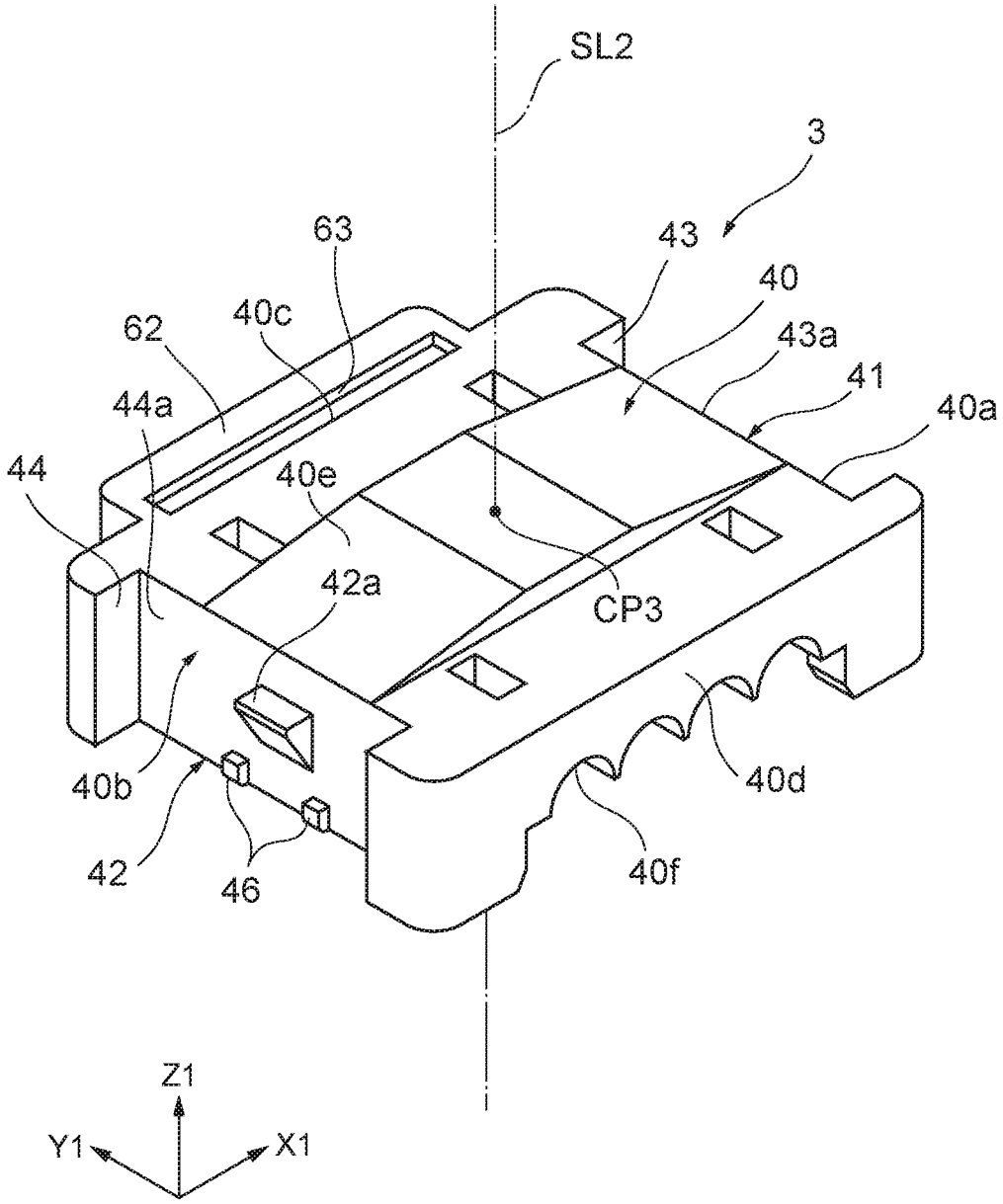
FIG. 5 is a perspective view of an upper-portion cover of the connector according to the embodiment.
Figure 6B:
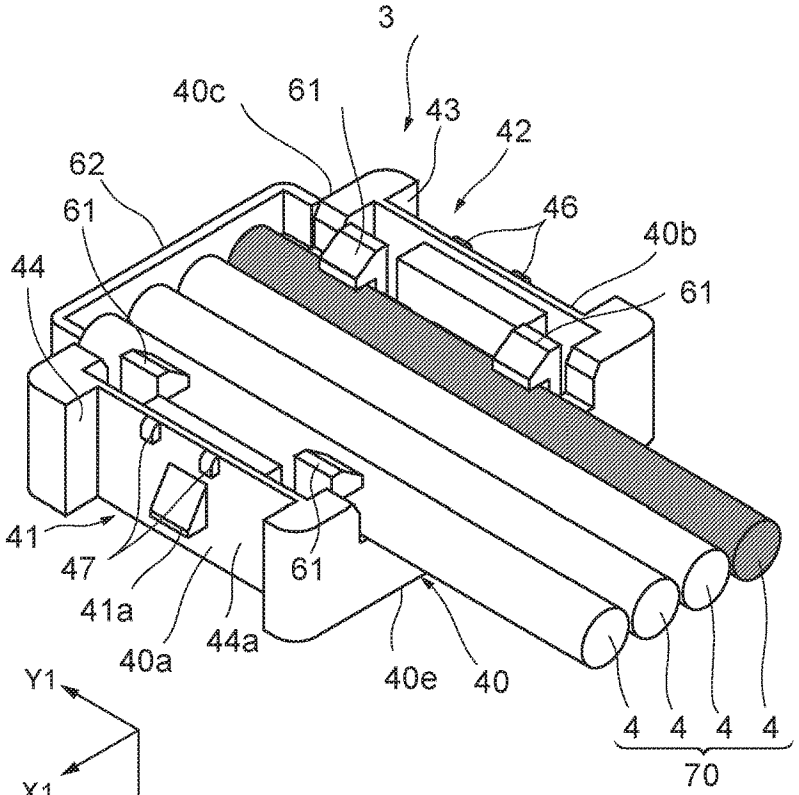
FIG. 6 is a perspective view of the upper-portion cover of the connector according to the embodiment.
Figure 6A:
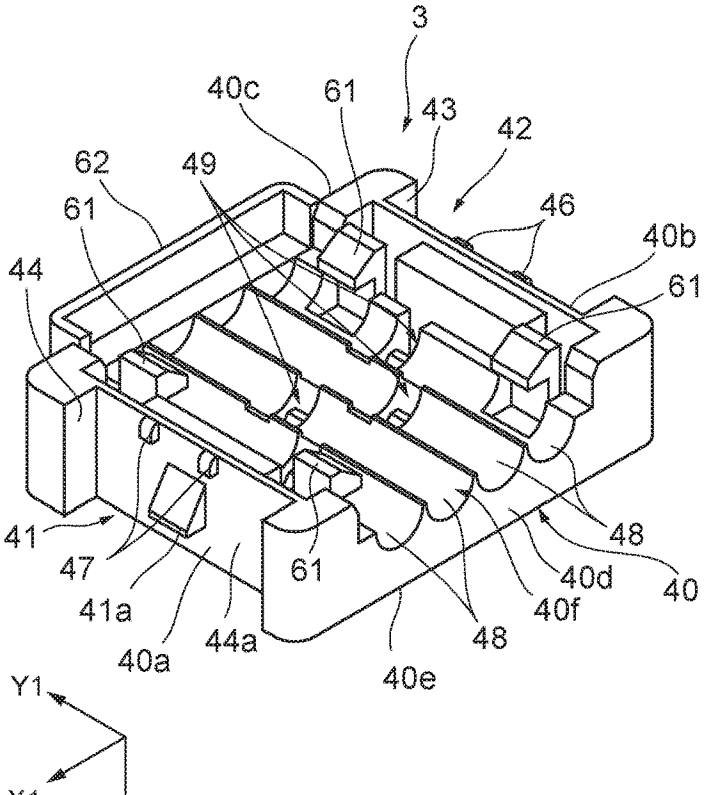

A configuration of the upper-portion cover 3 is described with reference to FIGS. 5 and 6. Note that the upper-portion cover 3 can move independently of the housing 2. Therefore, for the sake of description, a coordinate system different from the XYZ coordinates set relative to the housing 2 is set relative to the upper-portion cover 3. This defines "X1-axis direction" and "Y1-axis direction," which are orthogonal to each other in a horizontal plane, and defines "Z1-axis direction," which is orthogonal to the X1-axis direction and the Y1-axis direction. The upper-portion cover 3 is a cover member that is detachably assembled to the upper portion 2A of the housing 2. The upper-portion cover 3 detachably engages with the first upper-portion end wall 11 and the second upper-portion end wall 12. The upper-portion cover 3 is provided with an upper wall 40 and a first upper-portion cover sidewall 41 and a second upper-portion cover sidewall 42 that oppose each other.

The upper wall 40 is a member of a rectangular plate shape that functions as a substrate of the upper-portion cover 3. The upper wall 40 has a first edge portion 40*a* and a second edge portion 40*b* that oppose each other in the X1-axis direction, a third edge portion 40*c* and a fourth edge portion 40*d* that oppose each other in the Y-axis direction, and an upper surface 40*e* and a bottom surface 40*f* that oppose each other in the Z-axis direction. The first edge portion 40*a* is an edge portion on an X1-axis positive side, and the second edge portion 40*b* is an edge portion on an X1-axis negative side. The third edge portion 40*c* is an edge portion on a Y1-axis positive side, and the fourth edge portion 40*d* is an edge portion on a Y1-axis negative side. The third edge portion 40*c* and the fourth edge portion 40*d* extend along the X1-axis direction between the first edge portion 40*a* and the second edge portion 40*b*. The upper wall 40 has a length along the X1-axis direction and a width along the Y1-axis direction.

The first upper-portion cover sidewall 41 and the second upper-portion cover sidewall 42 extend downward from the bottom surface 40*f* of the upper wall 40, interpose the bottom surface 40*f*, and oppose each other in the X1-axis direction. The first upper-portion cover sidewall 41 and the second upper-portion cover sidewall 42 respectively have upper-portion cover groove portions 43, 44 that receive the first upper-portion end wall 11 and the second upper-portion end wall 12 of the housing 2. The upper-portion cover groove portions 43, 44 have shapes corresponding to those of the upper-portion end walls 11, 12.

The first upper-portion cover sidewall 41 and the second upper-portion cover sidewall 42 respective have engaging portions 41*a*, 42*a* that detachably engage with the engaged portions 21*a*, 22*a* provided on the upper-portion end wall 11 and the upper-portion end wall 12 of the housing 2. The engaging portions 41*a*, 42*a* are configured by a latch portion that engages with upper edges of the opening portions 21, 22 that are the engaged portions 21*a*, 22*a*. The engaging portions 41*a*, 42*a* are formed on side surfaces 43*a*, 44*a* of the upper-portion cover groove portions 43, 44. Moreover, below the engaging portions 41*a*, 42*a* and on a lower edge of the side surfaces 43*a*, 44*a*, a pair of protruding portions 46, 47 is respectively formed for temporarily holding the upper-portion cover 3 to the housing 2. These protruding portions 46, 47 temporarily hold by abutting and supporting the upper edges 21*a*, 22*a* of the upper-portion end walls 11, 12 at a step before pressing the upper-portion cover 2 to the housing 2 (see FIG. 8).

A plurality of grooves 48 that respectively receives the plurality of first insulated conductors 4 is formed in the bottom surface 40*f* of the upper-portion cover 3. The grooves 48 extend over substantially an entire region between the edge portions 40*c*, 40*d* along the Y1-axis direction. A hole 49 for avoiding interference with the blade portions 37*a* of the electrical contact terminal 16 when the upper-portion cover 3 is installed to the housing is formed in each groove 48. Moreover, a protruding portion 49*a* for a support when inserting the first insulated conductor 4 in the gap 37*b* of the blade portions 37*a* is provided in the hole 49 (see FIG. 8). Moreover, a hook 61 for holding the first insulated conductor 4 in the state of being housed in the groove 48 to the upper-portion cover 3 is provided on the bottom surface 40*f*.

Figure 13:
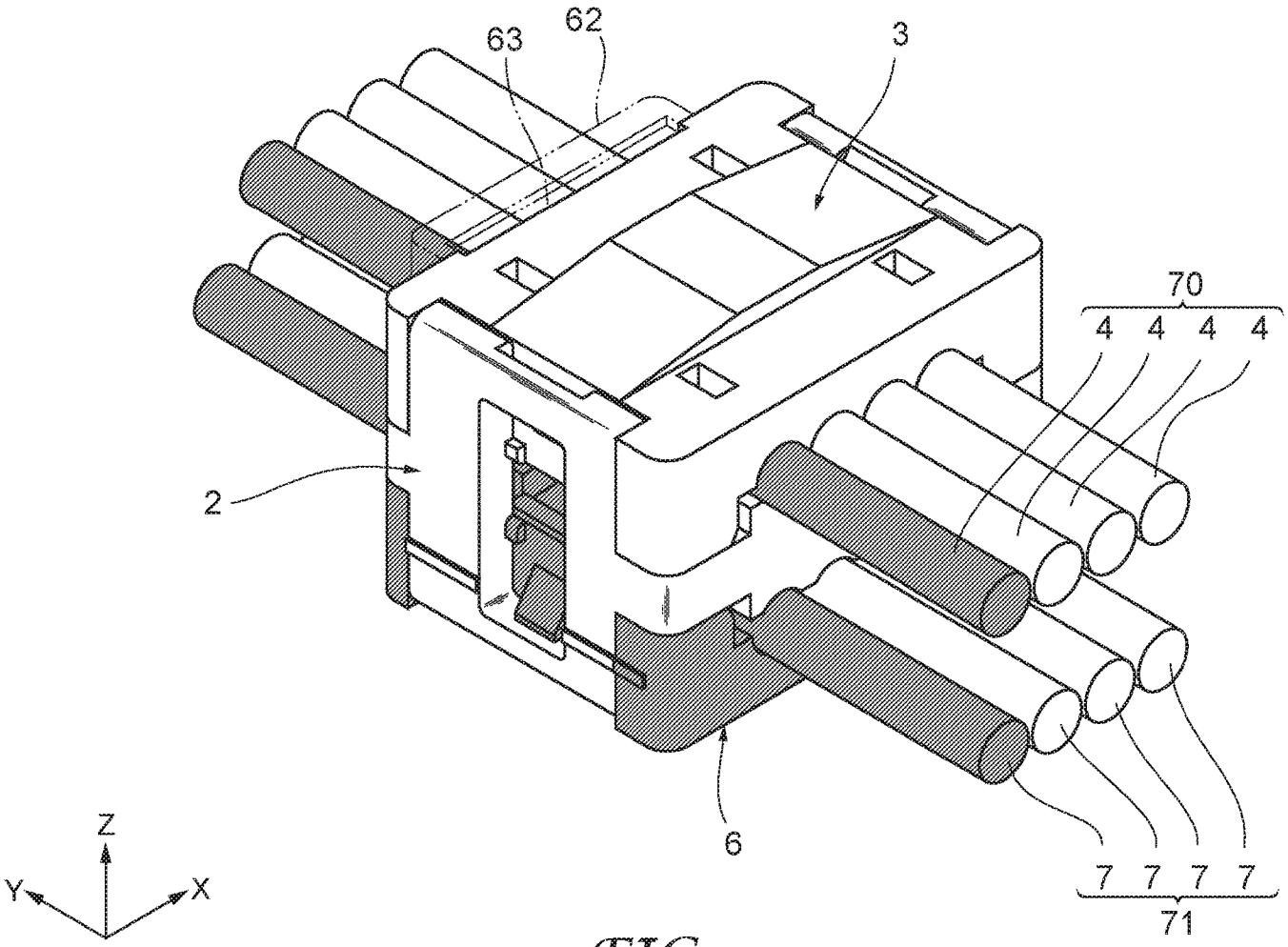
FIG. 13 is a perspective view of the connector assembly illustrating a branch line pulled out from both sides of the upper-portion cover.

By such a configuration, the first insulated conductor 4 held by the upper-portion cover 3 is pulled out from an opening portion of the fourth edge portion 40*d* of the cover 3. Meanwhile, a regulating portion 62 for regulating the pulling out by abutting an end portion of the first insulated conductor 4 is provided on a third-edge-portion 40*c* side. The regulating portion 62 is configured by a wall-shaped member separated in a Y1-axis positive direction relative to an opening portion of the third edge portion 40*c*. Note that a slit 63 is formed between the regulating portion 62 and the third edge portion 40*c*. This slit 63 functions as a viewing window for confirming a state of the first insulated conductor 4 held by the upper-portion cover 3. Moreover, as illustrated in FIG. 13, the regulating portion 62 can be easily cut at a portion of the slit 63. Therefore, the first insulated conductor 4 may be pulled out from both sides of the upper-portion cover 3 by removing the regulating portion 62.

On the upper-portion cover 3, a symmetry point CP3 set in a central position of the upper wall 40 and a symmetry axis SL2 that passes through the symmetry point CP3 and is orthogonal to the X1 axis and the Y1 axis are set. In a situation where the upper surface 40*e* is viewed downward from above (that is, toward a Z1-axis positive direction), at least the upper-portion cover groove portions 43, 44 are in point symmetry with the symmetry point CP3 set on the upper surface 40*e* as reference. In the present embodiment, an entirety of the upper-portion cover 3 is in point symmetry with the symmetry point CP3 as reference. However, "point symmetry" here ignores structures of the regulating portion 62 and the slit 63, which have no relation to assembling the housing 2 and the upper-portion cover 3.

Next, a point symmetry structure of the upper-portion cover 3 is described in more detail with reference to FIG. 9. FIG. 9 is a schematic view illustrating the upper surface 40*e* viewed downward from above (that is, toward a Z1-axis negative direction). The first upper-portion cover groove portion 43 and the second upper-portion cover groove portion 44 have common portions 43A, 44A that are portions overlapping each other in the X1-axis direction. A dimension of the common portions 43A, 44A is the dimension A1. The first upper-portion cover groove portion 43 and the second upper-portion cover groove portion 44 respectively have a first upper-portion offset portion 43B and a second upper-portion offset portion 44B by being offset from each other along the Y1-axis direction. An offset amount of the first upper-portion offset portion 43B and an offset amount of the second upper-portion offset portion 44B are the same, both being the dimension B1. The first upper-portion offset portion 43B and the second upper-portion offset portion 44B are offset with a clockwise direction relative to the upper-portion symmetry point CP3 as reference. The first upper-portion cover groove portion 43 is offset in a Y1-axis negative direction. Therefore, the first upper-portion offset portion 43B extends by the dimension B1 in the Y1-axis negative direction from the common portion 43A. The first upper-portion cover groove portion 43 is disposed in a position near the fourth edge portion 40*d* compared to the third edge portion 40*c*. Meanwhile, the second upper-portion cover groove portion 44 is offset in the Y1-axis positive direction. Therefore, the second upper-portion offset portion 44B extends by the dimension B1 in the Y1-axis positive direction from the common portion 44A. The second upper-portion cover groove portion 44 is disposed in a position near the third edge portion 40*c* compared to the fourth edge portion 40*d*.

By a configuration such as that described above, as evident in comparing FIGS. 9(*a*) and 9(*b*), an appearance is identical to that of a situation where the upper-portion cover 3 is rotated 180° around the upper-portion symmetry point CP3.

Bottom-Portion Cover

Figure 7:
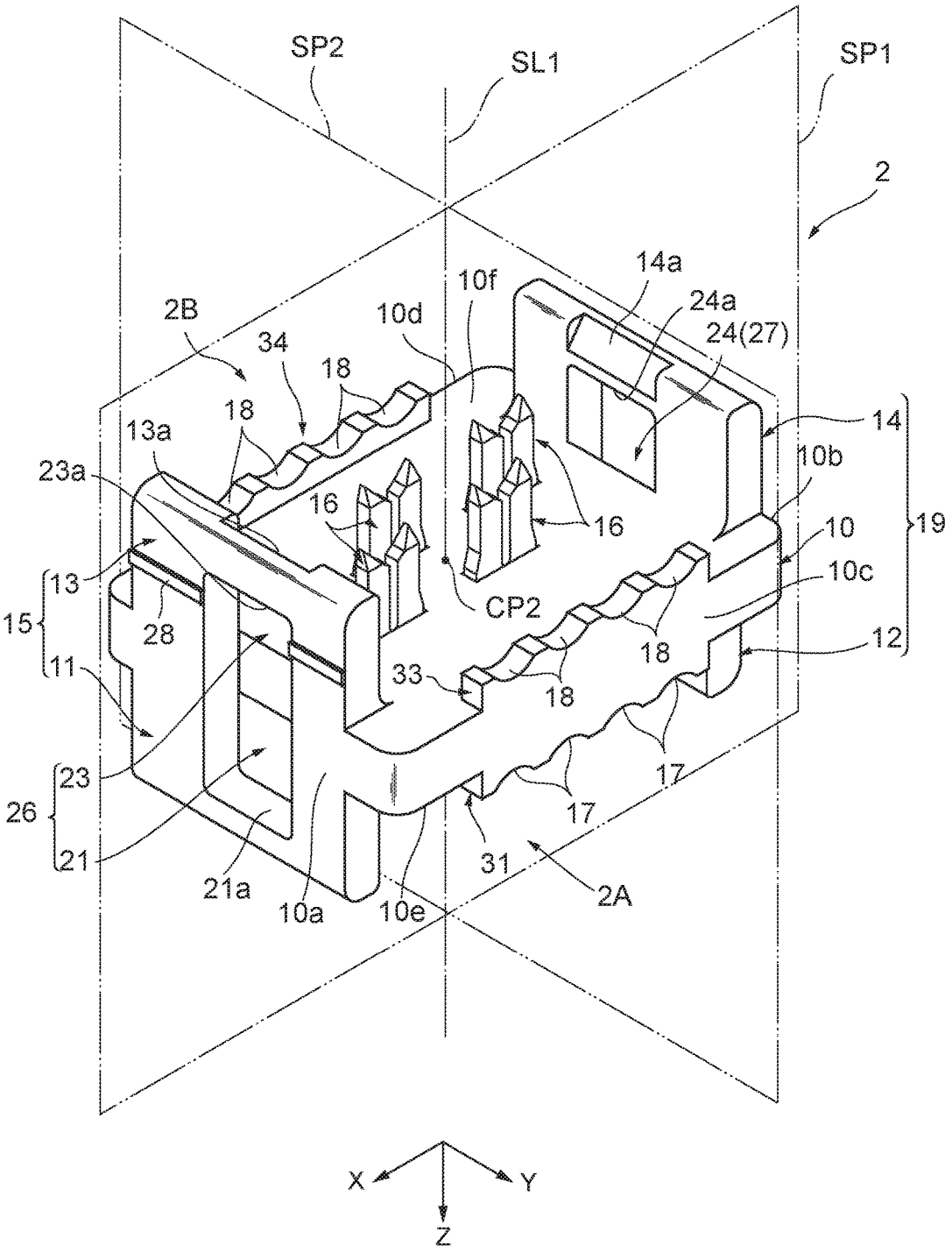
FIG. 7 is a perspective view of a bottom-portion cover of the connector according to the embodiment.

A configuration of the bottom-portion cover 6 is described with reference to FIG. 7. Note that the bottom-portion cover 6 can move independently of the housing 2. Therefore, for the sake of description, a coordinate system different from the XYZ coordinates set relative to the housing 2 is set relative to the bottom-portion cover 6. This defines "X2-axis direction" and "Y2-axis direction," which are orthogonal to each other in a horizontal plane, and defines "Z2-axis direction," which is orthogonal to the X2-axis direction and the Y2-axis direction. The bottom-portion cover 6 is a cover member that is detachably assembled to the bottom portion 2B of the housing 2. The bottom-portion cover 6 detachably engages with the first bottom-portion end wall 13 and the second bottom-portion end wall 14. The bottom-portion cover 6 is provided with a bottom wall 50 and a first bottom-portion cover sidewall 51 and a second bottom-portion cover sidewall 52 that oppose each other.

The bottom wall 50 is a member of a rectangular plate shape that functions as a substrate of the bottom-portion cover 6. The bottom wall 50 has a first edge portion 50*a* and a second edge portion 50*b* that oppose each other in the X2-axis direction, a third edge portion 50*c* and a fourth edge portion 50*d* that oppose each other in the Y2-axis direction, and an upper surface 50*e* and a bottom surface 50*f* that oppose each other in the Z2-axis direction. The first edge portion 50*a* is an edge portion on an X2-axis positive side, and the second edge portion 50*b* is an edge portion on an X2-axis negative side. The third edge portion 50*c* is an edge portion on a Y2-axis positive side, and the fourth edge portion 50*d* is an edge portion on a Y2-axis negative side. The third edge portion 50*c* and the fourth edge portion 50*d* extend along the X2-axis direction between the first edge portion 50*a* and the second edge portion 50*b*. The bottom wall 50 has a length along the X2-axis direction and a width along the Y2-axis direction.

The first bottom-portion cover sidewall 51 and the second bottom-portion cover sidewall 52 extend upward from the upper surface 50*e* of the bottom wall 50, interpose the upper surface 50*e*, and oppose each other in the X2-axis direction. The first bottom-portion cover sidewall 51 and the second bottom-portion cover sidewall 52 respectively have bottom-portion cover groove portions 53, 54 that receive the first bottom-portion end wall 13 and the second bottom-portion end wall 14 of the housing 2. The bottom-portion cover groove portions 53, 54 have shapes corresponding to those of the bottom-portion end walls 13, 14.

The first bottom-portion cover sidewall 51 and the second bottom-portion cover sidewall 52 respective have engaging portions 51*a*, 52*a* that detachably engage with the engaged portions 23*a*, 24*a* provided on the bottom-portion end wall 13 and the bottom-portion end wall 14 of the housing 2. The engaging portions 51*a*, 52*a* are configured by a latch portion that engages with upper edges of the opening portions 23, 24 that are the engaged portions 23*a*, 24*a*. The engaging portions 51*a*, 52*a* are formed on side surfaces 53*a*, 54*a* of the bottom-portion cover groove portions 53, 54. Moreover, above the engaging portions 51*a*, 52*a* and on an upper edge of the side surfaces 53*a*, 54*a*, a pair of protruding portions 56, 57 is respectively formed for temporarily holding the bottom-portion cover 6 to the housing 2. These protruding portions 56, 57 temporarily hold by abutting and supporting the upper edges 23*a*, 24*a* of the bottom-portion end walls 13, 14 at a step before pressing the bottom-portion cover 6 to the housing 2 (see FIG. 8).

A plurality of grooves 58 that respectively receives the plurality of second insulated conductors 7 is formed in the upper surface 50*e* of the bottom-portion cover 6. The grooves 58 extend over substantially an entire region between the edge portions 50*c*, 50*d* along the Y2-axis direction. Note that in a state of the connector assembly 100 where the upper-portion cover 3 and the bottom-portion cover 6 are assembled to the housing 2, the upper-portion cover 3 and the bottom-portion cover 6 have a configuration of being in planar symmetry to each other with a symmetry plane set between the upper-portion cover 3 and the bottom-portion cover 6 as reference (details of the configuration of plane symmetry are described below). Therefore, because a configuration of the upper surface 50*e* of the bottom-portion cover 6 has a configuration of the same spirit as that of the bottom surface 40*f* of the upper-portion cover 3, description is omitted. However, the bottom-portion cover 6 does not have a regulating portion. Moreover, on an outer surface in the X2-axis direction of the bottom-portion cover 6, a marker 69 is formed.

On the bottom-portion cover 6, a symmetry point CP4 set in a central position of the bottom wall 50 and a symmetry axis SL3 that passes through the symmetry point CP4 and is orthogonal to the X2 axis and the Y2 axis are set. In a situation where the bottom surface 50*f* is viewed upward from below (that is, toward a Z2-axis positive direction), at least the bottom-portion cover groove portions 53, 54 are in point symmetry with the symmetry point CP4 set on the bottom surface 50*f* as reference. In the present embodiment, an entirety of the bottom-portion cover 6 is in point symmetry with the symmetry point CP4 as reference.

Next, a point symmetry structure of the bottom-portion cover 6 is described in more detail with reference to FIG. 10. FIG. 10 is a schematic view illustrating the bottom surface 50*f* viewed upward from below (that is, toward the Z2-axis positive direction). The first bottom-portion cover groove portion 53 and the second bottom-portion cover groove portion 54 have common portions 53A, 54A that are portions overlapping each other in the X2-axis direction. A dimension of the common portions 53A, 54A is the dimension A2. The first bottom-portion cover groove portion 53 and the second bottom-portion cover groove portion 54 respectively have a first bottom-portion offset portion 53B and a second bottom-portion offset portion 54B by being offset from each other along the Y2-axis direction. An offset amount of the first bottom-portion offset portion 53B and an offset amount of the second bottom-portion offset portion 54B are the same, both being the dimension B2. The first bottom-portion offset portion 53B and the second bottom-portion offset portion 54B are offset with a counterclockwise direction relative to the bottom-portion symmetry point CP4 as reference. The first bottom-portion cover groove portion 53 is offset in a Y2-axis positive direction. Therefore, the first bottom-portion offset portion 53B extends by the dimension B2 in the Y2-axis positive direction from the common portion 53A. The first bottom-portion cover groove portion 53 is disposed in a position near the third edge portion 50*c* compared to the fourth edge portion 50*d*. Meanwhile, the second bottom-portion cover groove portion 54 is offset in a Y2-axis negative direction. The second bottom-portion offset portion 54B extends by the dimension B2 in the Y2-axis negative direction from the common portion 54A. Therefore, the second bottom-portion cover groove portion 54 is disposed in a position near the fourth edge portion 50*d* compared to the third edge portion 50*c*.

By a configuration such as that described above, as evident in comparing FIGS. 10(*a*) and 10(*b*), an appearance is identical to that of a situation where the bottom-portion cover 6 is rotated 180° around the upper-portion symmetry point CP4.

In the state of the connector assembly 100 where the upper-portion cover 3 and the bottom-portion cover 6 are assembled to the housing 2, as illustrated in FIG. 1, the upper-portion cover 3 and the bottom-portion cover 6 have a configuration of being in planar symmetry to each other with a symmetry plane SP3 set between the upper-portion cover 3 and the bottom-portion cover 6 as reference. In the structure in FIG. 1, a virtual plane that divides the base 10 of the housing 2 at a central position in the Z-axis direction and spreads orthogonally to the Z axis is set as the symmetry plane SP3. In the connector assembly 100, each component is disposed so the symmetry axis SL1 of the housing 2, the symmetry axis SL2 of the upper-portion cover 3, and the symmetry axis SL3 of the bottom-portion cover 6 match. Therefore, the symmetry plane SP3 spreads orthogonally to the symmetry axes SL1, SL2, SL3. Note that here, "planar symmetry" does not require all shapes of the upper-portion cover 3 and the bottom-portion cover 6 to be completely in point symmetry; for example, in a situation where the upper wall 40 and the bottom wall 50 or the cover sidewalls 41, 42, 51, 52 are formed with a rib, a hole, or the like (that does not affect functionality as a connector), these structures may be ignored. Note that it is sufficient for at least the upper-portion cover sidewalls 41, 42 and the bottom-portion cover sidewalls 51, 52 to be in planar symmetry; for example, depending on the shape of the upper wall 40 and the bottom wall 50, these do not have to be in planar symmetry.

Next, actions and effects of the present invention are described with reference to FIGS. 9 to 12.

As illustrated in FIG. 9, in a situation where the upper-portion main surface 10*e* of the housing 2 is viewed downward from above (that is, toward the Z-axis negative direction), at least the first upper-portion end wall 11 and the second upper-portion end wall 12 are in point symmetry with the upper-portion symmetry point CP1 set on the upper-portion main surface 10*e* as reference. Moreover, in a situation where the upper surface 40*e* of the upper-portion cover 3 is viewed downward from above (that is, toward the Z1-axis positive direction), at least the first upper-portion cover groove portions 43, 44 are in point symmetry with the symmetry point CP3 set on the upper surface 40*e* as reference. Therefore, the upper-portion cover 3 can be assembled to the upper portion 2A of the housing 2 in a state where the upper-portion cover groove portion 43 receives the first upper-portion end wall 11 and the second upper-portion cover groove portion 44 receives the second upper-portion end wall 12. Moreover, the upper-portion cover 3 can also be assembled to the upper portion 2A of the housing 2 in a state where the upper-portion cover groove portion 43 receives the second upper-portion end wall 12 and the second upper-portion cover groove portion 44 receives the first upper-portion end wall 11. Therefore, because the upper-portion cover 3 can be assembled to the upper portion 2A of the housing 2 regardless of the orientations of the housing 2 and the upper-portion cover 3, a worker can perform installation work without being concerned about orientation.

As illustrated in FIG. 10, with the housing 2, in the situation where the bottom-portion main surface 10*f* is viewed upward from below (that is, toward the Z-axis positive direction), at least the first bottom-portion end wall 13 and the second bottom-portion end wall 14 are in point symmetry with the bottom-portion symmetry point CP2 set on the bottom-portion main surface 10*f* as reference. Moreover, in the situation where the bottom surface 50*f* is viewed upward from below (that is, toward the Z2-axis positive direction), at least the bottom-portion cover groove portions 53, 54 are in point symmetry with the symmetry point CP4 set on the bottom surface 50*f* as reference. Therefore, the bottom-portion cover 6 can be assembled to the bottom portion 2B of the housing 2 in a state where the bottom-portion cover groove portion 53 receives the first bottom-portion end wall 13 and the second bottom-portion cover groove portion 54 receives the second bottom-portion end wall 14. Moreover, the bottom-portion cover 6 can also be assembled to the bottom portion 2B of the housing 2 in a state where the bottom-portion cover groove portion 53 receives the second bottom-portion end wall 14 and the second bottom-portion cover groove portion 54 receives the first bottom-portion end wall 13. Therefore, because the bottom-portion cover 6 can be assembled to the bottom portion 2B of the housing 2 regardless of the orientations of the housing 2 and the bottom-portion cover 6, the worker can perform installation work without being concerned about orientation. Therefore, working efficiency improves.

Figure 11B:
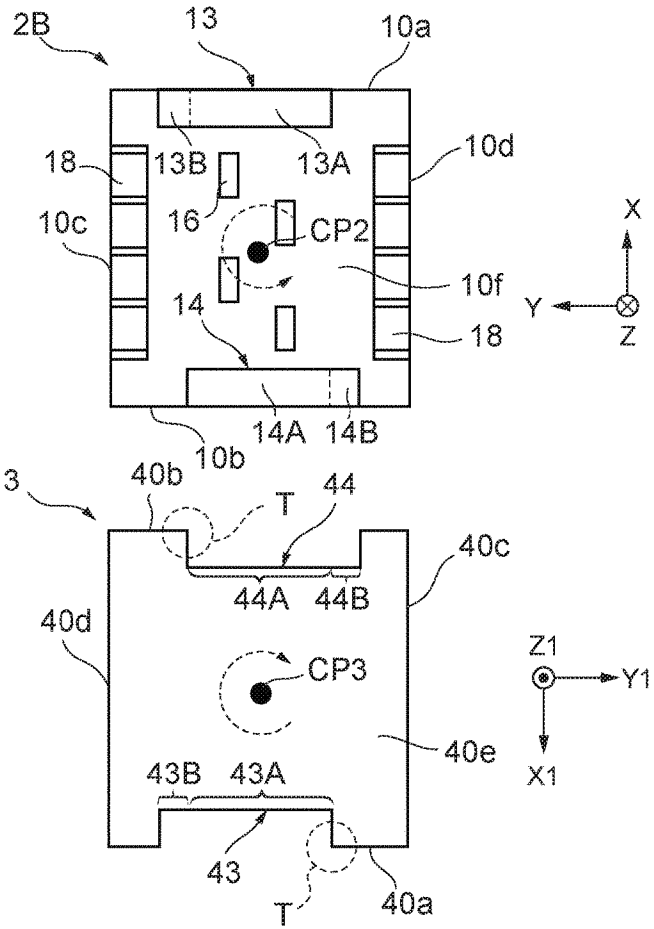
FIG. 11 is a schematic view for describing incorrect assembly prevention.
Figure 11A:
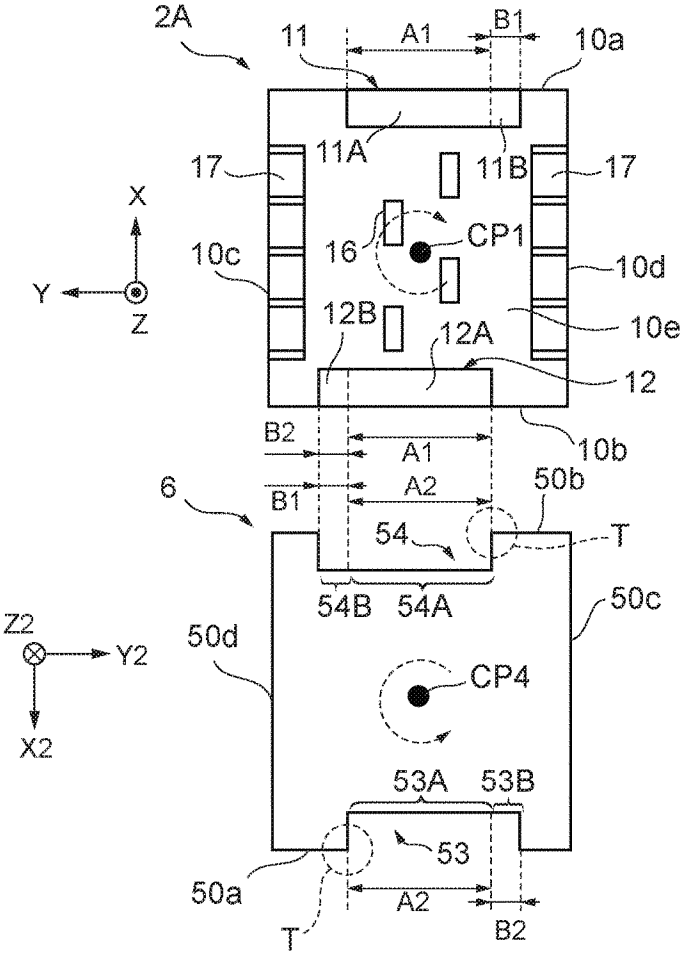

Furthermore, the first upper-portion end wall 11 and the second upper-portion end wall 12 respectively have the first upper-portion offset portion 11B and the second upper-portion offset portion 12B by being offset from each other along the Y-axis direction. The first bottom-portion end wall 13 and the second bottom-portion end wall 14 respectively have the first bottom-portion offset portion 13B and the second bottom-portion offset portion 14B by being offset from each other along the Y-axis direction. Here, the first upper-portion offset portion 11B and the second upper-portion offset portion 12B are offset with the clockwise direction relative to the upper-portion symmetry point CP1 as reference. Meanwhile, the first bottom-portion offset portion 13B and the second bottom-portion offset portion 14B are offset with the counterclockwise direction relative to the bottom-portion symmetry point CP2 as reference. By such a configuration, as illustrated in FIG. 11(*a*), in a situation where the bottom-portion cover 6 is attempted to be installed to the upper portion 2A of the housing 2, the upper-portion offset portions 11B, 12B interfere with the edge portions 50*a*, 50*b* (portions on an opposite side of an offset direction of the bottom-portion offset portions 53B, 54B; portions illustrated by T in the diagram) of the bottom-portion cover 6. Therefore, the worker incorrectly assembling the bottom-portion cover 6 to the upper portion 2A of the housing 2 can be prevented. Moreover, as illustrated in FIG. 11(*b*), in a situation where the upper portion cover 3 is attempted to be installed to the bottom portion 2B of the housing 2, the bottom-portion offset portions 13B, 14B interfere with the edge portions 40*a*, 40*b* (portions on an opposite side of an offset direction of the upper-portion offset portions 43B, 44B; portions illustrated by T in the diagram) of the upper-portion cover 3. Therefore, the worker incorrectly assembling the upper-portion cover 3 to the bottom portion 2B of the housing 2 can be prevented. Therefore, because the worker no longer needs to be concerned about incorrect assembly, the working efficiency improves.

Figure 12:
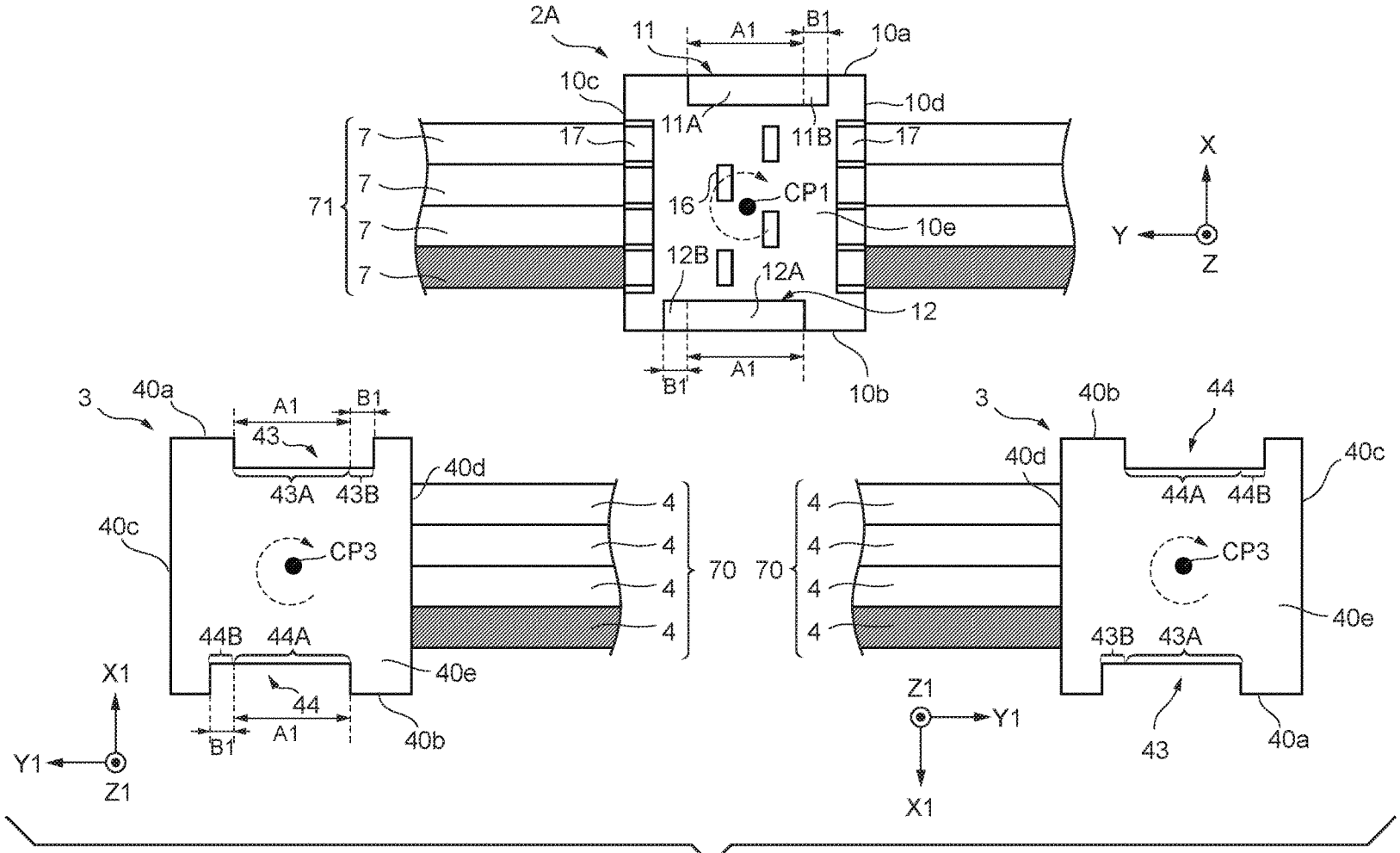
FIG. 12 is a schematic view for describing an installation direction of the upper-portion cover.

In the connector 1 according to the present embodiment, with regard to an installation orientation of the branch line 70 relative to the upper-portion cover 3 and an installation orientation of the trunk line 71 relative to the bottom-portion cover 6 as well, the worker no longer needs to be concerned. For example, as illustrated in FIG. 12, a situation is considered where the worker assembles the bottom-portion cover 6 and the trunk line 71 so that among the plurality of second insulated conductors 7, one that is colored (in the diagram, the second insulated conductor 7 illustrated in grayscale) is disposed on the X-axis negative side. In this situation, there is a need to assemble the branch line 70 to the housing 2 so a colored first insulated conductor 4 is electrically connected to the colored second insulated conductor 7. However, the worker, when installing the branch line 70 to the upper-portion cover 3, may assemble the branch line 70 in any orientation. For example, even in a situation where the colored first insulated conductor 4 is disposed on the first-edge-portion 40*a* side or the second-edge-portion 40*b* side of the upper-portion cover 3, it is sufficient to rotate, adjust in a correct orientation, and assemble the upper-portion cover 3 at a time of assembling the upper-portion cover 3 to the housing 2. That is, the worker, when assembling the trunk line 71 to the bottom-portion cover 6, when assembling the bottom-portion cover 6 to the housing 2, and when assembling the branch line 70 to the upper-portion cover 3, does not need to be concerned about orientation; it is sufficient for the worker to be concerned about an assembly orientation only when ultimately assembling the upper-portion cover 3 to the housing 2 by viewing the colored insulated conductors 4, 7. By the above, a botheration of the work and a work of determining an assembly direction can be mitigated; therefore, the working efficiency improves.

As described above, the connector according to one aspect of the present invention is a connector that electrically connects a plurality of first insulated conductors and a plurality of second insulated conductors that correspond, wherein the connector is provided with a housing; the housing is provided with a base that has a length along a first direction between a first edge portion and a second edge portion that oppose each other and a width along a second direction orthogonal to the first direction, a first end wall and a second end wall that extend in an up-and-down direction respectively from the first edge portion and the second edge portion, a plurality of first grooves and a plurality of second grooves that are provided in an upper-portion main surface and a bottom-portion main surface of the base that oppose each other and respectively receive the plurality of first insulated conductors and the plurality of second insulated conductors, and a plurality of electrical contact terminals that is provided in correspondence with the first grooves and the second grooves and contacts the first insulated conductors received in the first grooves and the second insulated conductors received in the second grooves so the first insulated conductors and the second insulated conductors are electrically connected to each other; and the housing is set with a symmetry axis that is orthogonal to the first direction and the second direction.

In such an aspect, the housing has the first end wall and the second end wall that extend in the up-and-down direction, the plurality of first grooves and the plurality of second grooves that respectively receive the plurality of first insulated conductors and the plurality of second insulated conductors, and the plurality of electrical contact terminals. Therefore, the upper-portion cover can be assembled to the housing together with the plurality of first insulated conductors, and the bottom-portion cover can be assembled to the housing together with the plurality of second insulated conductors. Moreover, the plurality of first insulated conductors and the plurality of second insulated conductors received by the plurality of first grooves and the plurality of second grooves can be electrically connected to each other by the electrical contact terminals. Here, the housing is set with the symmetry axis that is orthogonal to the first direction and the second direction. Therefore, the upper-portion cover can be assembled to the upper portion of the housing regardless of orientation, and the bottom-portion cover can be assembled to the bottom portion of the housing regardless of orientation. By the above, ease of assembly work for the connector assembly can be improved.

Furthermore, in a connector according to another aspect, the first end wall and the second end wall may be offset from each other along the second direction. By this, a configuration is achieved where an offset direction of the first upper-portion end wall and the second upper-portion end wall and an offset direction of the first bottom-portion end wall and the second bottom-portion end wall are different. Therefore, incorrect assembly of the upper-portion cover and the bottom-portion cover to the housing can be prevented.

Furthermore, in a connector according to another aspect, the base may have a third edge portion and a fourth edge portion that extend along the first direction between the first edge portion and the second edge portion and oppose each other; the base may be provided with an upper-side step portion that protrudes upward from the upper-portion main surface and extends along the third edge portion and the fourth edge portion, and a lower-side step portion that protrudes downward from the bottom-portion main surface and extends along the third edge portion and the fourth edge portion; and the upper-side step portion may be provided with the first grooves and the lower-side step portion may be provided with the second grooves. By this, at the upper-side step portion protruding from the upper-portion main surface and the lower-side step portion protruding from the bottom-portion main surface, the insulated conductor can be received in a groove. By this, the insulated conductor can be securely supported.

Furthermore, in a connector according to another aspect, further provided may be an upper-portion cover that detachably engages with a portion extending upward from the base at the first end wall and the second end wall, and a bottom-portion cover that detachably engages with a portion extending downward from the base at the first end wall and the second end wall.

A connector assembly according to one aspect of the present invention is provided with: a housing; an upper-portion cover that is detachably assembled to an upper portion of the housing; a plurality of first insulated conductors that is disposed between the housing and the upper-portion cover; a bottom-portion cover that is detachably assembled to a bottom portion of the housing; a plurality of second insulated conductors that is disposed between the housing and the bottom-portion cover; and a plurality of electrical contact terminals that contacts the first insulated conductors and the second insulated conductors so as to electrically connect the first insulated conductors and the second insulated conductors to each other; wherein the housing is set with a symmetry axis, and the upper-portion cover and the bottom-portion cover have configurations in planar symmetry with each other with a symmetry plane set between the upper-portion cover and the bottom-portion cover as reference.

In such an aspect, actions and effects similar to the connector described above can be obtained.

A connector according to one aspect of the present invention is a connector that electrically connects a plurality of first insulated conductors and a plurality of second insulated conductors that correspond, wherein the connector is provided with a housing; the housing is provided with a base that has an upper-portion main surface and a bottom-portion main surface that oppose each other, a first upper-portion end wall and a second upper-portion end wall that extend upward from the base and oppose each other in a first opposing direction interposing the upper-portion main surface, a first bottom-portion end wall and a second bottom-portion end wall that extend downward from the base and oppose each other in a second opposing direction interposing the bottom-portion main surface, and a plurality of electrical contact terminals that is held by the base and contacts the first insulated conductors and the second insulated conductors so as to electrically connect the first insulated conductors and the second insulated conductors to each other; in a situation where the upper-portion main surface is viewed downward from above, the first upper-portion end wall and the second upper-portion end wall are in point symmetry with an upper-portion symmetry point set on the upper-portion main surface as reference, and the first upper-portion end wall and the second upper-portion end wall respectively have a first upper-portion offset portion and a second upper-portion offset portion by being offset from each other along a direction orthogonal to the first opposing direction; an offset amount of the first upper-portion offset portion and an offset amount of the second upper-portion offset portion are the same, the first upper-portion offset portion and the second upper-portion offset portion being offset with one direction, clockwise or counterclockwise, relative to the upper-portion symmetry point as reference; in a situation where the bottom-portion main surface is viewed upward from below, the first bottom-portion end wall and the second bottom-portion end wall are in point symmetry with a bottom-portion symmetry point set on the bottom-portion main surface as reference, and the first bottom-portion end wall and the second bottom-portion end wall respectively have a first bottom-portion offset portion and a second bottom-portion offset portion by being offset from each other along a direction orthogonal to the second opposing direction; and an offset amount of the first bottom-portion offset portion and an offset amount of the second bottom-portion offset portion are the same, the first bottom-portion offset portion and the second bottom-portion offset portion being offset with the other direction, clockwise or counterclockwise, relative to the bottom-portion symmetry point as reference.

In such an aspect, in the situation where the upper-portion main surface is viewed downward from above, the first upper-portion end wall and the second upper-portion end wall are in point symmetry with the upper-portion symmetry point set on the upper-portion main surface as reference; therefore, the worker does not need to be concerned about orientation with regard to the upper portion of the housing in assembling the upper-portion cover. Moreover, in the situation where the bottom-portion main surface is viewed upward from below, the first bottom-portion end wall and the second bottom-portion end wall are in point symmetry with the bottom-portion symmetry point set on the bottom-portion main surface as reference; therefore, the worker does not need to be concerned about orientation with regard to the bottom portion of the housing in assembling the bottom-portion cover. Moreover, the first upper-portion end wall and the second upper-portion end wall respectively have the first upper-portion offset portion and the second upper-portion offset portion by being offset from each other along the direction orthogonal to the first opposing direction. The first bottom-portion end wall and the second bottom-portion end wall respectively have the first bottom-portion offset portion and the second bottom-portion offset portion by being offset from each other along the direction orthogonal to the second opposing direction. In such a configuration, the first upper-portion offset portion and the second upper-portion offset portion are offset with one direction, clockwise or counterclockwise, relative to the upper-portion symmetry point as reference, and the first bottom-portion offset portion and the second bottom-portion offset portion are offset with the other direction, counterclockwise or clockwise, relative to the bottom-portion symmetry point as reference. Therefore, because the offset directions of the upper-portion offset portion and the bottom-portion offset portions are different from each other on the upper-portion side and the bottom-surface side, the worker incorrectly assembling the bottom-portion cover to the upper-portion of the housing and incorrectly assembling the upper-portion cover to the bottom portion of the housing can be prevented. By the above, ease of assembly work for the connector assembly can be improved.

Furthermore, in a connector according to another aspect, the first opposing direction and the second opposing direction may match, the first upper-portion end wall and the first bottom-portion end wall may be configured as an end wall continuous in an up-and-down direction, and the second upper-portion end wall and the second bottom-portion end wall may be configured as an end wall continuous in the up-and-down direction. In such a configuration, by forming the end walls continuous in the up-and-down direction, each upper-portion end wall and bottom-portion end wall can be simultaneously formed; therefore, a structure can be simplified.

Furthermore, in a connector according to another aspect, further provided may be an upper-portion cover that is detachably assembled to an upper portion of the housing, and a bottom-portion cover that is detachably assembled to a bottom portion of the housing; the upper-portion cover may have a first upper-portion cover sidewall and a second upper-portion cover sidewall that oppose each other; the first upper-portion cover sidewall and the second upper-portion cover sidewall may respectively have an upper-portion cover groove portion that receives the first upper-portion end wall and the second upper-portion end wall of the housing; the first upper-portion cover sidewall and the second upper-portion cover sidewall may respectively have engaging portions that detachably engage with engaged portions provided on the first upper-portion end wall and the second upper-portion end wall of the housing; the bottom-portion cover may have a first bottom-portion cover sidewall and a second bottom-portion cover sidewall that oppose each other; the first bottom-portion cover sidewall and the second bottom-portion cover sidewall may respectively have a bottom-portion cover groove portion that receives the first bottom-portion end wall and the second bottom-portion end wall of the housing; and the first upper-portion cover sidewall and the second upper-portion cover sidewall may respectively have engaging portions that detachably engage with engaged portions provided on the first upper-portion end wall and the second upper-portion end wall of the housing. By using an upper-portion cover and bottom-portion cover configured in this manner, the actions and effects of the connector described above can be more reliably realized.

A connector assembly according to one aspect of the present invention is a connector assembly that uses the connector described above, provided with: the housing; an upper-portion cover that is detachably assembled to an upper portion of the housing; a bottom-portion cover that is detachably assembled to a bottom portion of the housing; the plurality of first insulated conductors that is disposed between the housing and the upper-portion cover; and the plurality of second insulated conductors that is disposed between the housing and the bottom-portion cover. In such an aspect, actions and effects similar to those of the connector described above can be obtained.

The present invention is not limited to the embodiment described above.

Figure 14:
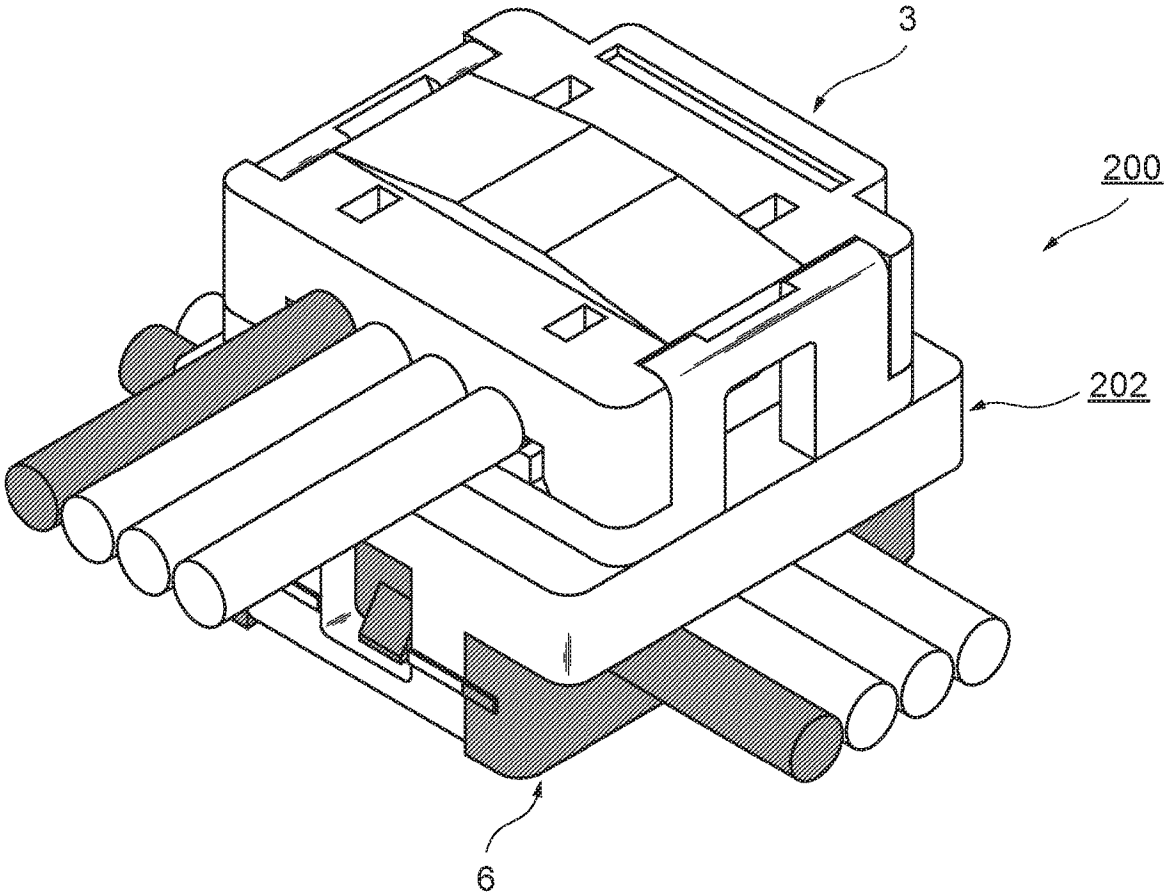
FIG. 14 is a perspective view of a connector assembly using a connector according to a modified example.

For example, in the embodiment described above, description is given of an example where the opposing direction of the upper-portion end wall and the opposing direction of the bottom-portion end wall match, but these directions may be different from each other. For example, in a connector assembly 200 using a connector 202 illustrated in FIG. 14, the opposing direction of the upper-portion end wall and the opposing direction of the bottom-portion end wall are orthogonal. However, they do not have to be orthogonal and may intersect at another angle.

Furthermore, in the embodiment described above, the housing is provided with the first groove and the second groove for receiving the insulated conductor, but these grooves may be omitted. For example, in a situation where a flat cable is used as the trunk line and the branch line, a cross section of a bundle of a plurality of insulated conductors becomes a rectangular shape. Therefore, a groove for receiving the insulated conductors here becomes unnecessary. In this situation, an upper-side step portion and a lower-side step portion that does not have a groove may be provided.

REFERENCE SIGNS LIST

1 . . . connector; 2 . . . housing; 3 . . . upper-portion cover; 4 . . . first insulated conductor; 6 . . . bottom-portion cover; 7 . . . second insulated conductor; 10 . . . base; 11 . . . first upper-portion end wall; 12 . . . second upper-portion end wall; 13 . . . first bottom-portion end wall; 14 . . . second bottom-portion end wall; 15 . . . first end wall; 16 . . . electrical contact terminal; 17 . . . first groove; 18 . . . second groove; 19 . . . second end wall; 31, 32 . . . upper-side step portion; 33, 34 . . . lower-side step portion; 41 . . . first upper-portion cover sidewall; 42 . . . second upper-portion cover sidewall; 43 . . . first upper-portion cover groove portion; 44 . . . second upper-portion cover groove portion; 51 . . . first bottom portion cover sidewall; 52 . . . second bottom portion cover sidewall; 53 . . . first bottom portion cover groove portion; 54 . . . second bottom portion cover groove portion.

The invention claimed is:

1. A connector that electrically connects a plurality of first insulated conductors and a plurality of second insulated conductors that correspond, wherein the connector is provided with a housing;

the housing is provided with a base that has a length along a first direction between a first edge portion and a second edge portion that oppose each other and a width along a second direction orthogonal to the first direction, a first end wall and a second end wall that extend in an up-and-down direction respectively from the first edge portion and the second edge portion, a plurality of first grooves and a plurality of second grooves that are provided in an upper-portion main surface and a bottom-portion main surface of the base that oppose each other and respectively receive the plurality of first insulated conductors and the plurality of second insulated conductors, and a plurality of electrical contact terminals that is provided in correspondence with the first grooves and the second grooves and contacts the first insulated conductors received in the first grooves and the second insulated conductors received in the second grooves so the first insulated conductors and the second insulated conductors are electrically connected to each other; and the housing is set with a symmetry axis, but not a symmetry plane, that is orthogonal to the first direction and the second direction.

2. The connector according to claim 1, wherein the first end wall and the second end wall are offset from each other along the second direction.

3. The connector according to claim 1, wherein the base has a third edge portion and a fourth edge portion that extend along the first direction between the first edge portion and the second edge portion and oppose each other;

the base is provided with an upper-side step portion that protrudes upward from the upper-portion main surface and extends along the third edge portion and the fourth edge portion and a lower-side step portion that protrudes downward from the bottom-portion main surface and extends along the third edge portion and the fourth edge portion; and the upper-side step portion is provided with the first grooves and the lower-side step portion is provided with the second grooves.

4. The connector according to claim 1, further provided with an upper-portion cover that detachably engages with a portion extending upward from the base at the first end wall and the second end wall, and a bottom-portion cover that detachably engages with a portion extending downward from the base at the first end wall and the second end wall.

5. A connector assembly, comprising: a housing;

an upper-portion cover that is detachably assembled to an upper portion of the housing;

a plurality of first insulated conductors that is disposed between the housing and the upper-portion cover;

a bottom-portion cover that is detachably assembled to a bottom portion of the housing;

a plurality of second insulated conductors that is disposed between the housing and the bottom-portion cover; and a plurality of electrical contact terminals that contacts the first insulated conductors and the second insulated conductors so as to electrically connect the first insulated conductors and the second insulated conductors to each other; wherein the housing is set with a symmetry axis, but not a symmetry plane, and the upper-portion cover and the bottom-portion cover have configurations in planar symmetry with each other with a symmetry plane set between the upper-portion cover and the bottom-portion cover as reference.

6. A connector that electrically connects a plurality of first insulated conductors and a plurality of second insulated conductors that correspond, wherein the connector is provided with a housing;

the housing is provided with a base that has an upper-portion main surface and a bottom-portion main surface that oppose each other, a first upper-portion end wall and a second upper-portion end wall that extend upward from the base and oppose each other in a first opposing direction interposing the upper-portion main surface, a first bottom-portion end wall and a second bottom-portion end wall that extend downward from the base and oppose each other in a second opposing direction interposing the bottom-portion main surface, and a plurality of electrical contact terminals that is held by the base and contacts the first insulated conductors and the second insulated conductors so as to electrically connect the first insulated conductors and the second insulated conductors to each other;

in a situation where the upper-portion main surface is viewed downward from above, the first upper-portion end wall and the second upper-portion end wall are in point symmetry with an upper-portion symmetry point set on the upper-portion main surface as reference, and the first upper-portion end wall and the second upper-portion end wall respectively have a first upper-portion offset portion and a second upper-portion offset portion by being offset from each other along a direction orthogonal to the first opposing direction;

an offset amount of the first upper-portion offset portion and an offset amount of the second upper-portion offset portion are the same, the first upper-portion offset portion and the second upper-portion offset portion being offset with one direction, clockwise or counterclockwise, relative to the upper-portion symmetry point as reference;

in a situation where the bottom-portion main surface is viewed upward from below, the first bottom-portion end wall and the second bottom-portion end wall are in point symmetry with a bottom-portion symmetry point set on the bottom-portion main surface as reference, and the first bottom-portion end wall and the second bottom-portion end wall respectively have a first bottom-portion offset portion and a second bottom-portion offset portion by being offset from each other along a direction orthogonal to the second opposing direction; and an offset amount of the first bottom-portion offset portion and an offset amount of the second bottom-portion offset portion are the same, the first bottom-portion offset portion and the second bottom-portion offset portion being offset with the other direction, clockwise or counterclockwise, relative to the bottom-portion symmetry point as reference, wherein the housing does not have a symmetry plane that is orthogonal to the first and second directions.

7. The connector according to claim 6, wherein the first opposing direction and the second opposing direction match, the first upper-portion end wall and the first bottom-portion end wall are configured as an end wall continuous in an up-and-down direction, and the second upper-portion end wall and the second bottom-portion end wall are configured as an end wall continuous in the up-and-down direction.

8. The connector according to claim 6, wherein further provided are an upper-portion cover that is detachably assembled to an upper portion of the housing, and a bottom-portion cover that is detachably assembled to a bottom portion of the housing;

the upper-portion cover has a first upper-portion cover sidewall and a second upper-portion cover sidewall that oppose each other;

the first upper-portion cover sidewall and the second upper-portion cover sidewall respectively have an upper-portion cover groove portion that receives the first upper-portion end wall and the second upper-portion end wall of the housing;

the first upper-portion cover sidewall and the second upper-portion cover sidewall respectively have engaging portions that detachably engage with engaged portions provided on the first upper-portion end wall and the second upper-portion end wall of the housing;

the bottom-portion cover has a first bottom-portion cover sidewall and a second bottom-portion cover sidewall that oppose each other;

the first bottom-portion cover sidewall and the second bottom-portion cover sidewall respectively have a bottom-portion cover groove portion that receives the first bottom-portion end wall and the second bottom-portion end wall of the housing; and the first bottom-portion cover sidewall and the second bottom-portion cover sidewall respectively have engaging portions that detachably engage with engaged portions provided on the first bottom-portion end wall and the second bottom-portion end wall of the housing.

9. A connector assembly that uses the connector according to claim 6, comprising:

the housing;

an upper-portion cover that is detachably assembled to an upper portion of the housing;

a bottom-portion cover that is detachably assembled to a bottom portion of the housing;

the plurality of first insulated conductors that is disposed between the housing and the upper-portion cover; and the plurality of second insulated conductors that is disposed between the housing and the bottom-portion cover.

* * * * *